US007404552B2

(12) United States Patent
Abe et al.

(10) Patent No.: US 7,404,552 B2
(45) Date of Patent: Jul. 29, 2008

(54) PAPER SHEET HANDLING APPARATUS, AUTOMATIC TRANSACTION APPARATUS, AND PAPER SHEET CONVEYING APPARATUS

(75) Inventors: Hayami Abe, Kawasaki (JP); Kazuto Kitano, Inagi (JP); Hayato Minamishin, Inagi (JP); Hiroshi Miyazaki, Inagi (JP)

(73) Assignees: Fujitsu Limited, Kawasaki (JP); NCR Corporation, Dayton, OH (US)

( * ) Notice: Subject to any disclaimer, the term of this patent is extended or adjusted under 35 U.S.C. 154(b) by 159 days.

(21) Appl. No.: 11/518,547

(22) Filed: Sep. 11, 2006

(65) Prior Publication Data

US 2007/0023988 A1 Feb. 1, 2007

Related U.S. Application Data

(63) Continuation of application No. PCT/JP2005/004371, filed on Mar. 11, 2005.

(30) Foreign Application Priority Data

Mar. 12, 2004 (JP) ..... 2004-071775

(51) Int. Cl.
*B65H 5/22* (2006.01)

(52) U.S. Cl. ..... 271/3.14; 271/4.01; 271/10.01; 209/534

(58) Field of Classification Search ..... 271/3.14, 271/4.01, 10.01; 209/534
See application file for complete search history.

(56) References Cited

U.S. PATENT DOCUMENTS

| | | | | |
|---|---|---|---|---|
| 4,883,181 | A * | 11/1989 | Yoshikawa | 209/534 |
| 5,836,577 | A * | 11/1998 | Arikawa et al. | 270/58.04 |
| 2002/0011431 | A1* | 1/2002 | Graef et al. | 209/534 |
| 2003/0094402 | A1* | 5/2003 | Seo et al. | 209/534 |
| 2003/0196936 | A1* | 10/2003 | Graef et al. | 209/534 |

FOREIGN PATENT DOCUMENTS

| | | |
|---|---|---|
| JP | 2001-14511 | 1/2001 |
| JP | 2001-67511 | 3/2001 |

* cited by examiner

*Primary Examiner*—David H Bollinger
(74) *Attorney, Agent, or Firm*—Kratz, Quintos & Hanson, LLP

(57) ABSTRACT

Paper sheets or the like inserted in a bundled state from the outside are conveyed in that state to an advancing section. Then, the paper sheets or the like, advanced on sheet by sheet basis from the advancing section, are conveyed to temporary holding section and received there. The reception of the paper sheets or the like, received in the temporary holding section in a stacked manner, is made by conveying them in a bundled state from the advancing section and advancing them on sheet by sheet basis.

16 Claims, 32 Drawing Sheets

PAPER SHEET HANDLING APPARATUS, AUTOMATIC TRANSACTION APPARATUS, AND PAPER SHEET CONVEYING APPARATUS

CROSS REFERENCE TO RELATED APPLICATION

This application is a continuation of international PCT application No. PCT/JP2005/004371 filed on Mar. 11, 2005.

BACKGROUND OF THE INVENTION

1. Field of the Invention

The present invention relates to a paper sheet handling apparatus for handling an externally inserted paper sheet, an automatic transaction apparatus provided with the paper sheet handling apparatus, and a paper sheet conveying apparatus loaded into the paper sheet handling apparatus.

2. Description of the Related Art

Recently, automated equipment (automatic transaction apparatus) such as an automatic cash dispenser (CD), an automatic teller machine (ATM), etc. is mounted not only in financial facilities but also a convenience store, etc. A paper sheet handling apparatus is loaded into such automated equipment to handle a bill as a paper sheet. In this case, an operation is performed at an instruction of the body of automated equipment.

Inputting a bill on a sheet by sheet basis is the more troublesome with an increasing number of bills to be input. Therefore, automated equipment allows bills to be deposited as a bundle of bills. Since only one bill can be input, the bundle of paper sheets can be one or more bills bundled.

It is necessary to authenticate a bill input by a client to automated equipment which allows bills to be deposited. Furthermore, it is necessary to perform a refund. Thus, the conventional paper sheet handling apparatus loaded into automated equipment which allows bills to be deposited advances bills input as a bundle of paper sheets on a sheet by sheet basis, conveys, and authenticates them. A bill discriminated as a normal bill in an authenticating process is temporarily stored in a temporarily holding section (patent document 1). A bill stored in the temporarily holding section is stored in a storage section when a client accepts a transaction, and refunded to the client when the client requests the refund.

A bill discriminated as a normal bill is piled and stored in the temporarily holding section. The conveying operation of bills from the temporarily holding section is performed by advancing bills on a sheet by sheet basis. Thus, the conventional paper sheet handling apparatus described in the patent document 1 conveys bills on a sheet by sheet basis in most cases.

The longer the distance of conveying bills, the higher the probability that a fault such as jamming, etc. occurs. Thus, the reliability becomes lower. When bills are conveyed on a sheet by sheet basis, the total distance of conveying bills becomes longer with an increasing number of bills, thereby lowering the reliability. Therefore, to enhance the reliability, it is considered that it is important to shorten the total distance of conveying all bills.

The conveying operation of a bundle of bills has conventionally been performed by providing convey belts above and below the bundle of bills with the feed belts pinching the bundle of bills (patent document 1).

Tension is applied to the feed belts to allow the conveying force to work on the bundle of bills. However, when the tension is applied, the feed belts are transformed to a relatively large extent by the force applied from the cross direction to the direction of the tension. Thus, the pressure applied to the bundle of bills is largely restricted. Therefore, it is hard to maintain the status of the bundle of bills, and the possibility that the bills appropriately piled are projected in the conveying direction. Thus, to further improve the reliability of the paper sheet handling apparatus (including an automatic transaction apparatus carrying the paper sheet handling apparatus) for conveying the bundle of bills (bundle of paper sheets), it is considered that it is important to correctly and appropriately convey the bundle of bills.

Patent Document 1: Japanese Patent Application Publication No. 2001-14511

Patent Document 2: Japanese Patent Application Publication No. 2001-67511

SUMMARY OF THE INVENTION

The first objective of the present invention is to provide a more reliable paper sheet handling apparatus. The second objective of the present invention is to provide a paper sheet conveying apparatus capable of correctly and appropriately conveying a bundle of paper sheets.

The paper sheet handling apparatus according to the first aspect of the present invention includes: a first bundle conveying section for conveying a bundle of paper sheets by externally inserting the bundle; an advancing section for advancing paper sheets on a sheet by sheet basis from the bundle of paper sheets conveyed from the first bundle conveying section; temporarily holding section for temporarily piling and temporarily storing a paper sheet; a storage section for sorting and storing a paper sheet; a first conveying section for conveying the paper sheet advanced by the advancing section to the temporarily holding section; a second bundle conveying section for conveying a bundle of paper sheets stored in the temporarily holding section to an advancing section; and a second conveying section for conveying to the storage section the paper sheet advanced by the advancing section after the second bundle conveying section conveys a bundle of paper sheets.

The paper sheet handling apparatus according to the second aspect of the present invention further includes in addition to the configuration according to the first aspect of the present invention: advance section for advancing on a sheet by sheet basis the paper sheet from the storage section; and a third conveying section for conveying the paper sheet advanced by the advance section to the temporarily holding section. The bundle of a paper sheet stored in the temporarily holding section by the third conveying section can be externally conveyed by the second bundle conveying section and the first bundle conveying section.

The paper sheet handling apparatus according to the third aspect of the present invention further includes, in addition to the configuration according to the first or second aspect of the present invention, diagonal status detection section for detecting the diagonal status of a bundle of paper sheets conveyed by the first bundle conveying section by external insertion. When the diagonal status detection section detects the diagonal status of a bundle of paper sheets, it externally conveys the bundle of paper sheets by the first bundle conveying section.

The paper sheet handling apparatus according to the fourth aspect of the present invention further includes, in addition to the configuration according to any of the first through third aspects of the present invention, height detection section for detecting the height of the bundle of paper sheets conveyed by the first bundle conveying section by external insertion. When the height of the bundle of paper sheets detected by the height detection section is higher than an upper limit value, the bundle of paper sheets is externally conveyed by the first bundle conveying section.

The automatic transaction apparatus according to the present invention is based on that a transaction is conducted based on the paper sheet externally inserted, and includes: a first bundle conveying section for conveying a bundle of paper sheets by externally inserting the bundle; an advancing section for advancing paper sheets on a sheet by sheet basis from the bundle of paper sheets conveyed from the first bundle conveying section; an authentication section for authenticating the paper sheet advanced by the advancing section; temporarily holding section for piling sorted paper sheets and temporarily storing the paper sheets depending on an authentication result of the authentication section; a storage section for piling and storing paper sheets; a first conveying section for conveying the paper sheets advanced by the advancing section to the temporarily holding section; a second bundle conveying section for conveying a bundle of paper sheets stored in the temporarily holding section to an advancing section; and a second conveying section for conveying to the storage section the paper sheets advanced by the advancing section after the second bundle conveying section conveys a bundle of paper sheets. Thus, a transaction is conducted based on an authentication result of externally input paper sheets.

The paper sheet conveying apparatuses according to the first through fourth aspect of the present invention are based on that the apparatus is loaded into the paper sheet handling apparatus for convey of a bundle of paper sheets formed by bundling one or more sheets, each of the paper sheets conveying apparatuses includes the following section.

The paper sheet conveying apparatus according to the first aspect of the present invention includes: a tray provided at one end of the cross direction to the plane of the paper sheet inserted in a form of a bundle of paper sheets; travel section for moving a tray in a convey direction of a bundle of paper sheets; and pressure section for allowing pressure to a tray to work on a bundle of paper sheets.

It is preferable that the pressure section allows pressure to work on the bundle of paper sheets by moving convey section provided at the other end of the cross direction for convey of a bundle of paper sheets toward a tray.

The paper sheet conveying apparatus according to the second aspect of the present invention further includes, in addition to the above-mentioned first aspect of the present invention, a projecting member capable of making a projection toward one of the conveying section and the tray, saving the status of the projection, and moving the bundle of paper sheets in a convey direction. A bundle of paper sheets is conveyed using a projecting member.

In the third aspect of the present invention, it is preferable that a bundle of paper sheets can be conveyed using a projecting member by entering the state in which the bundle of paper sheets pinched by the conveying section and the tray through the pressure section, conveying the bundle of paper sheets by the conveying section and the tray, and then releasing the pinching state by the pressure section, and moving the projecting member in the projected status from the back in the conveying direction of the bundle of paper sheets to the conveying direction. It is preferable that the projecting member is used with the guide of a length with which a bundle of paper sheets is to be inserted with the projecting member in the projecting state, and a preferable attachment place is a tray.

When a bundle of paper sheets is externally inserted, it is preferable that a projecting member attached at a tray is first used for a guide of a length with which the bundle of paper sheets is to be inserted with the projecting member set in the projected state, and then evacuated, and the tray is moved in the inverse direction of the conveying direction, and the projecting member is projected, thus conveying the bundle of paper sheets.

The paper sheet conveying apparatus according to the third aspect of the present invention further includes, in addition to the configuration according to the second aspect, an other projecting member provided opposite side of the tray in which can be made projecting toward the tray and evacuating from the projected state. When the tray is moved in the inverse direction of the conveying direction, the state of the bundle of paper sheets is maintained by the other projecting member in the projected state.

The paper sheet conveying apparatus according to the fourth aspect of the present invention includes: first and second convey section provided for convey of the bundle of paper sheets on either side in the cross direction of the plane of paper sheets externally inserted in a form of a bundle of paper sheets; drive section for driving first and second convey section; pressure section for allowing pressure to work on a bundle of paper sheets between the first and second convey section by moving at least one of the first and second convey section in a cross direction; a projecting member capable of making a projection directed for one of the first and the second convey section, and saving from the projected state; and travel section for moving a projecting member in a convey direction of the bundle of paper sheets.

The paper sheet handling apparatus according to the present invention conveys a paper sheet externally inserted in a form of a bundle of paper sheets as is to an advancing section, conveys and stores a paper sheet advanced on a sheet by sheet basis from the advancing section to the temporarily holding section, and the paper sheet bundled and stored in the temporarily holding section is stored in the storage section by conveying the paper sheet from the temporarily holding section to the advancing section in a form of a bundle of paper sheets, and advancing the paper sheets on a sheet by sheet basis and then conveying it.

The inserted bundle of paper sheets and the paper sheet stored in a form of a bundle of paper sheets in the temporarily holding section is conveyed in a form of a bundle of paper sheets to the advancing section. Thus, as compared with the case in which a temporarily stored paper sheet is advanced on a sheet by sheet basis and conveyed, the conveying distance of conveying paper sheets on a sheet by sheet basis can be shorter. Since the paper sheet stored in the temporarily holding section can be externally conveyed in a form of a bundle of paper sheets, at least practically the distance can be shorter. Therefore, the probability that a fault such as jamming, etc. during convey can be reduced, and the reliability can be enhanced. Furthermore, since an externally inserted paper sheet is internally accepted in a form of a bundle of paper sheets, the size of the inserted portion of the bundle of paper sheets can be reduced.

It is common knowledge that an advancing section has a very complicated configuration. However, by conveying the paper sheet stored in the temporarily holding section to the advancing section in a form of a bundle of paper sheets, the paper sheet is advanced in the same place with a bundle of paper sheets inserted. Thus, since it is not necessary to prepare a plurality of advancing sections, the configuration of the mechanism of the entire apparatus can be simpler, and the production cost can be reduced.

When the diagonal status of an externally inserted bundle of paper sheets is to be detected, an inappropriate bundle of paper sheets can be ejected at an earlier stage. An upper limit value is set for a conveyable bundle of paper sheets. Thus, when the height of an externally inserted bundle of paper sheets is to be detected, an inappropriate bundle of paper sheets can be ejected at an earlier stage. Thus, in any case, the use rate of the apparatus can be improved.

The paper sheet conveying apparatus according to the present invention conveys a bundle of paper sheets by allowing pressure to work on the bundle of paper sheets toward a tray provided for one end of the cross direction of the plane of a paper sheet externally inserted in a form of a bundle of paper sheets, and moving the tray in the state.

The tray can be made of a member having sufficient rigidity. Therefore, by applying pressure toward a tray to a bundle of paper sheets, the status of the bundle of paper sheets can be stable maintained. As a result, the bundle of paper sheets can be more correctly and appropriately conveyed.

The paper sheet conveying apparatus according to another aspect of the present invention further includes first and second convey section on either side of the cross direction of the plane of the paper sheet externally inserted in a form of a bundle of paper sheets, and conveys the bundle of paper sheets with the paper sheet pinched between the conveying section, and simultaneously with the conveying operation of the bundle of paper sheets, or aside the conveying operation, the conveying operation using a projecting member having projecting and saving capabilities.

In the conveying operation using the projecting member, a bundle of paper sheets is pushed from behind by the projecting member. Therefore, the conveying force can be correctly transmitted to the bundle of paper sheets, and the status can be maintained in the appropriate state. As a result, the bundle of paper sheets can be more correctly and appropriately conveyed.

DESCRIPTION OF THE PREFERRED EMBODIMENTS

The embodiments of the present invention are explained below by referring to the attached drawings.

Figure 1:
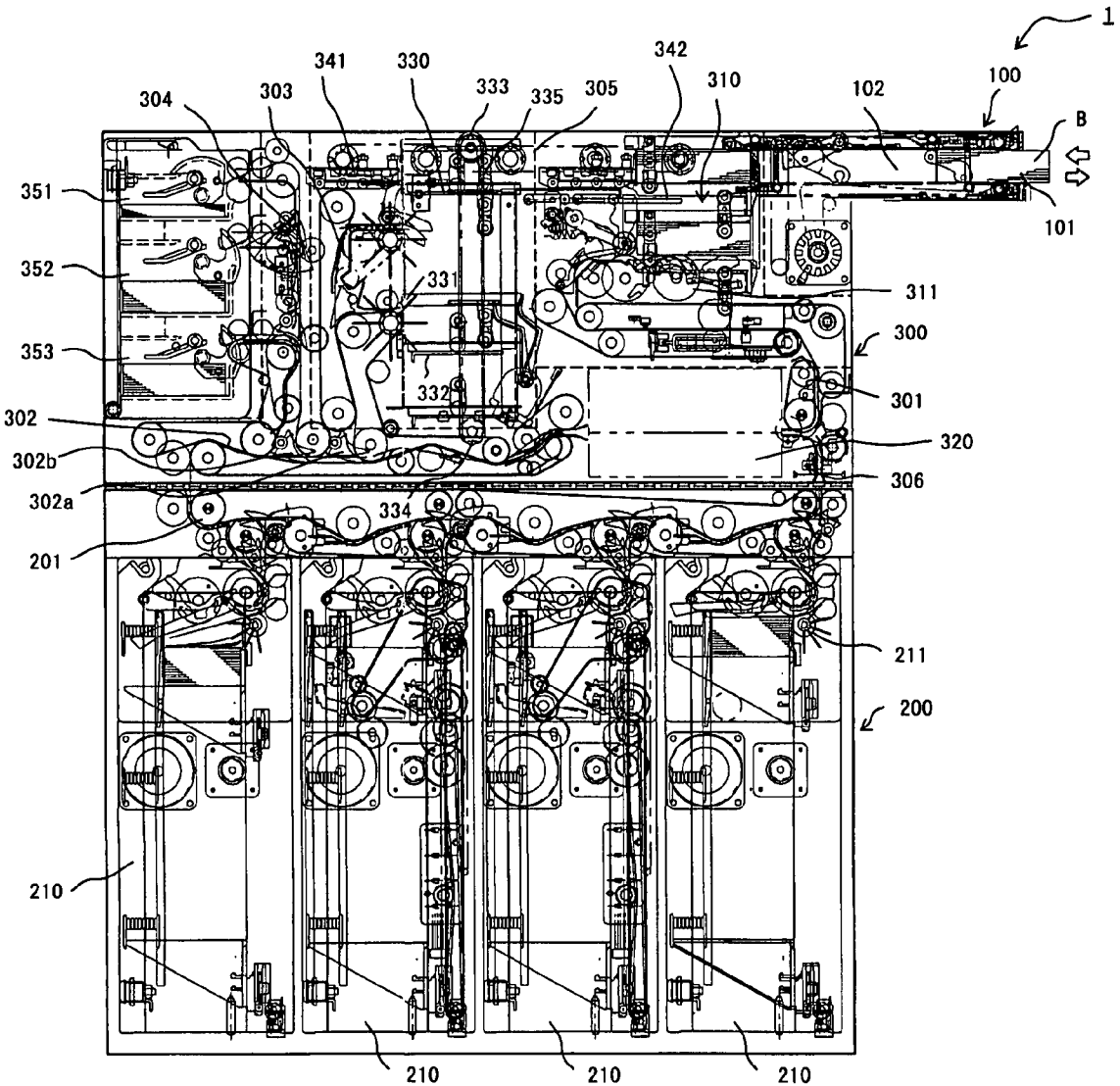
FIG. 1 is a sectional view of the paper sheet handling apparatus according to an embodiment of the present invention.

FIG. 1 is a sectional view of the paper sheet handling apparatus according to an embodiment of the present invention.

A paper sheet handling apparatus 1 handles a bill as a paper sheet based on the assumption that it is used for automated equipment, for example, an automatic teller machine (ATM). As shown in FIG. 1, the apparatus 1 comprises a pre-acceptor 100 for internally accepting a bundle of paper sheets B obtained by bundling one or more bills when a client inserts the bundle; a lower module 200 for storing a bill; and an upper module 300 for conveying bills between the lower module 200 and the pre-acceptor 100. The pre-acceptor 100 corresponds to the paper sheet conveying apparatus according to an embodiment of the present invention. The pre-acceptor 100 is hereinafter referred to as an "acceptor" or "PAC".

The operation of the paper sheet handling apparatus with the above-mentioned configuration is explained below. The paper sheet handling apparatus 1 is assumed to have deposit and withdrawal capabilities. Thus, the operations of the depositing process and the withdrawing process are individually explained. The automated equipment loaded with the apparatus can be an ATM, that is, the paper sheet handling apparatus 1 is assumed to operate at an instruction of the ATM.

A slot 101 provided for the acceptor 100 is used by a client when the client inputs a bundle of bills B for a deposit, or ejects the bundle of bills B for a withdrawal. When the apparatus 1 is loaded into the ATM, an open/close shutter (not shown in the attached drawings) is arranged outside the slot 101. Afterwards, from the viewpoint of the client, the slot 101 of the acceptor 100 is at the front side, and the opposite side is referred to as a back side. As viewed from the lower module 200, it is assumed that the upper module 300 is referred to as the upper portion. As viewed from the upper module 300, it is assumed that the lower module 200 is referred to as the lower portion.

The operation during the depositing operation is explained first. The depositing process is performed by, for example, a client operating the operation section (not shown in the attached drawings) of the ATM to request the depositing process. When the client makes a request, the ATM (the ATM) opens the shutter to shift the state of inserting the bundle of bills B to the slot 101, and instructs the paper sheet handling apparatus 1 to accept the bills to be inserted.

A sensor for detecting the inserted bundle of bills is arranged near the slot 101. Upon receipt of the instruction from the ATM, the paper sheet handling apparatus 1 conveys the bundle of bills after the sensor detects the bundle of bills B. By the conveying operation, the bundle of bills B is carried to a separator section (SEP) 310 of the upper module 300 through a conveying-path 102. For crime prevention, the paper sheet handling apparatus 1 is embedded in the wall, and the slot 101 and the client operation section of the ATM is projected from the wall so that a client can operate them. Therefore, when the bundle of bills B is accepted from the slot 101 or ejected from the slot 101, the bundle of bills B is conveyed through the conveying path 102. Thus, when the paper sheet handling apparatus 1 is embedded in the wall, bills are conveyed, input, and ejected as a bundle. Therefore, a client can easily handle the bills.

When the paper sheet handling apparatus 1 accepts the bundle of bills B inserted by a client, the ATM is notified of the acceptance. The ATM closes the shutter according to the notification.

An advancing mechanism 311 for advancing bills on a sheet by sheet basis from the bundle of bills B is provided below the separator section 310. The advancing mechanism 311 has, for example, a well-known configuration. Practically, for example, the configuration includes: a pick roller for transmitting the force in the advance direction to the bill placed at the lowest position; a feed roller for conveying a bill advanced by the pick roller; and a separator provided in the state in which the separator can contact the feed roller for preventing double convey of a bill.

Figure 2:
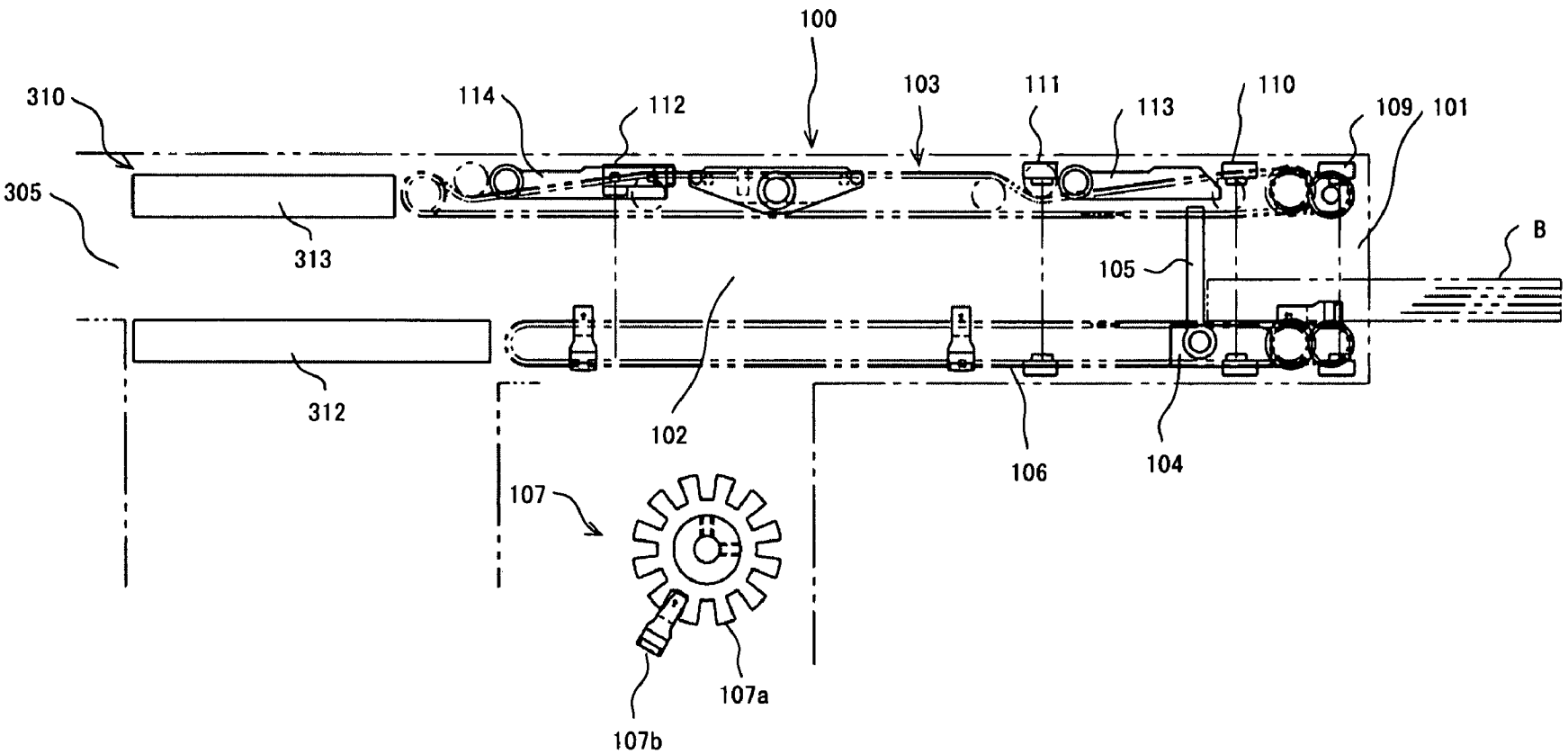
FIG. 2 is an explanatory view of the configuration of the conveying system of the paper sheet conveying apparatus (pre-acceptor) according to an embodiment of the present invention.

By the acceptor 100 conveying a bill to the separator section 310, the bundle of bills B is carried to a stage 312 in the status shown in FIG. 2. The stage 312 and a pusher 313 located above the stage 312 can be moved up and down. Thus, the conveying operation of the bundle of bills B to the position in which the advancing mechanism 311 can advance a bill is performed by moving the stage 312 downward. Since the positions of the stage 312 and the pusher 313 shown in FIG. 2 are the upper limit in the possible travel range, they are referred to as the upper end or the upper end position.

It is necessary to allow a bill to contact the pick roller by appropriate pressure. The pusher 313 is used to apply the pressure to contact them. The pressure is applied by moving the stage 312 downward to the lower end, moving the pusher 313 downward, and then applying pressure from above the bundle of bills B.

The stage 312 moved to the lower end of the pick roller is held by the elastic member not shown in the attached drawings to be able to move up and down. It is designed to determine from the change in position of the stage 312 whether or not appropriate pressure is applied in advancing a bill. Therefore, a sensor for detecting the pick roller stage 312 moved downward below the lower end by applied pressure is provided. By monitoring the detection result of the sensor, the pusher 313 is moved downward to apply appropriate pressure. Thus, the drive system for moving the stage 312 and the pusher 313 is individually prepared. Each power source for the movement is a stepping motor.

A bill advanced on a sheet by sheet basis from the separator section 310 by the advancing mechanism 311 is conveyed to the authentication section 320 through a conveying path 301, and is authenticated. By the authentication, it is discriminated whether or not the bill is a normal bill and the denomination of normal bill is designated. A counterfeit bill, a bill that cannot be authenticated, or a damaged bill is discriminated as an abnormal bill. After the authenticating process, the bill is conveyed through a conveying path 302.

Three reject boxes 351 through 353 are provided for the upper module 300. A temporarily holding section 330 is provided to temporarily store a bill input by a client. A conveying path 303 is provided to store a bill in the temporarily holding section 330, and a conveying path 304 is provided to store a bill in any of the reject boxes 351 through 353.

Two switch hooks 302*a* and 302*b* are mounted in the conveying path 302 to switch the conveying destination of a bill. The conveying path for conveying a bill being conveyed is switched by the switch hook 302*a* to the conveying path 303, and switched by the switch hook 302*b* to the conveying path 304. After a bill is handled in the authenticating process, it is conveyed from the conveying path 302 to the conveying path 303 by the switch hook 302*a*, and is stored in the temporarily holding section 330.

The temporarily holding section 330 is provided with two stages 331 and 332 which can be moved up and down. The stage 331 stores a bill discriminated as an abnormal bill, and the stage 332 stores a bill discriminated as a normal bill. For convenience in this example, the storage section realized by the stage 331 is referred to as a reservoir section, and the storage section realized by the stage 332 is referred to as an escrow section. The stage 331 is referred to as an RSV stage, and the ESC stage 332 is referred to as an ESC stage.

The stages 331 and 332 are attached to an extended belt 335 between two pulley rollers 333 and 334 provided with a space in a vertical direction. The two pulley rollers 333 and 334 and the belt 335 are prepared for each stage to individually move the stages 331 and 332.

A switch hook is arranged for the conveying path 303 so that the conveying destination of a bill can be selected from between the reservoir section and the escrow section. Thus, a bill conveyed through the conveying path 303 is stored in the reservoir section or the escrow section. The conveying path 304 is provided with two switch hook for allowing a bill to be stored in any of the reject boxes 351 through 353.

The authentication of a bill by a authentication section 320, and storage of the bill in the temporarily holding section 330 depending on the authentication result is performed on all bills advanced on a sheet by sheet basis from the separator section 310. Therefore, after bills are completely advanced from the separator section 310, it is assumed that the advanced bills are accumulated and stored in the reservoir section in the temporarily holding section 330 or the escrow section and stored depending on the authentication result of the authentication section 320. The completion of the advancing operation can be determined by a sensor confirming that there is no bill remained in the separator section 310, or by a sensor confirming that no bill is advanced to the conveying path 301 although an advancing operation is performed.

When bills insert in a form of a bundle of bills B are completely stored in the temporarily holding section 330, the paper sheet handling apparatus 1 notifies the ATM of the completion. The number of bills determined as normal bills by the authentication section 320 is counted for each denomination of bill, and the calculated amount of a deposit is also notified. According to the notifications, the ATM presents the amount of a deposit to the client, and inquires the client whether or not the transaction is to be conducted, whether or not there is an additional deposit, etc. Afterwards, operations are performed depending on the inquiry results.

When a client requests an additional deposit, the ATM opens the shutter again, and instructs the paper sheet handling apparatus 1 to accept the inserted bills B. The bills as a bundle of bills inserted by a client are stored in the reservoir section of the temporarily holding section 330 or the escrow section as described above.

When a client requests a cancellation of a transaction, the ATM instructs the paper sheet handling apparatus 1 to refund the accepted bills. The bills are normally stored in the reservoir section of the temporarily holding section 330, the escrow section, or both of them. The paper sheet handling apparatus 1 refunds the bills as follows depending on the storage location.

Figure 11A:
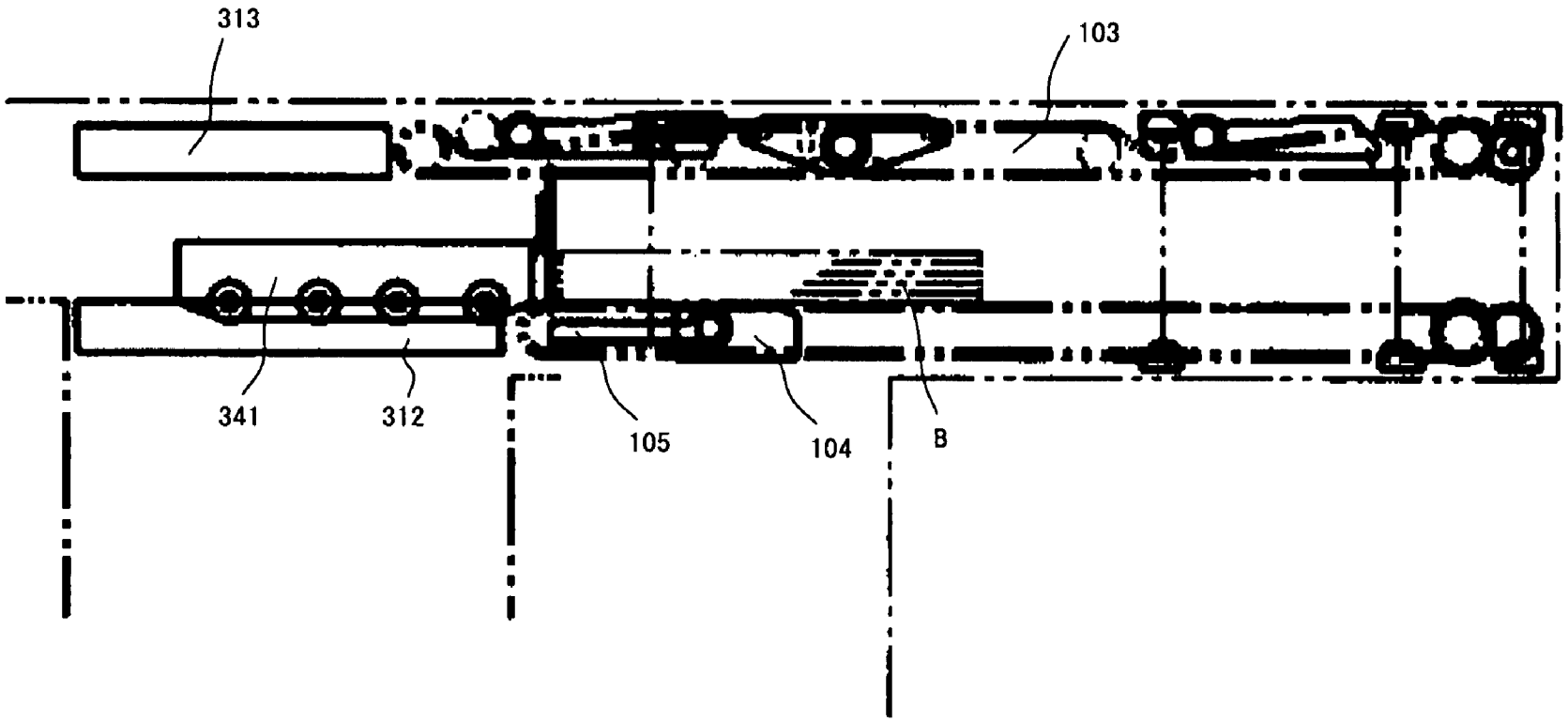
FIG. 11A is an explanatory view (1) of the operation of the pre-acceptor during the withdrawing operation.
Figure 11B:
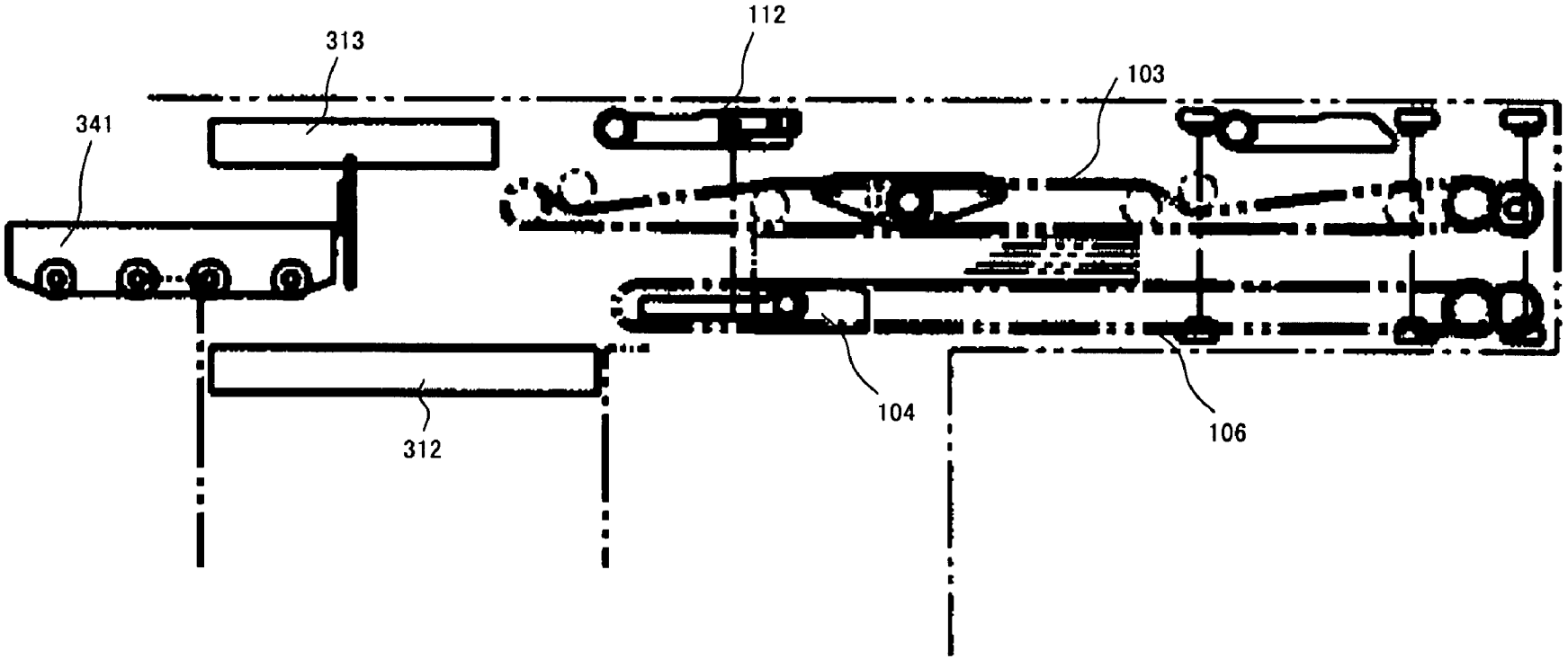
FIG. 11B is an explanatory view (2) of the operation of the pre-acceptor during the withdrawing operation.
Figure 11C:
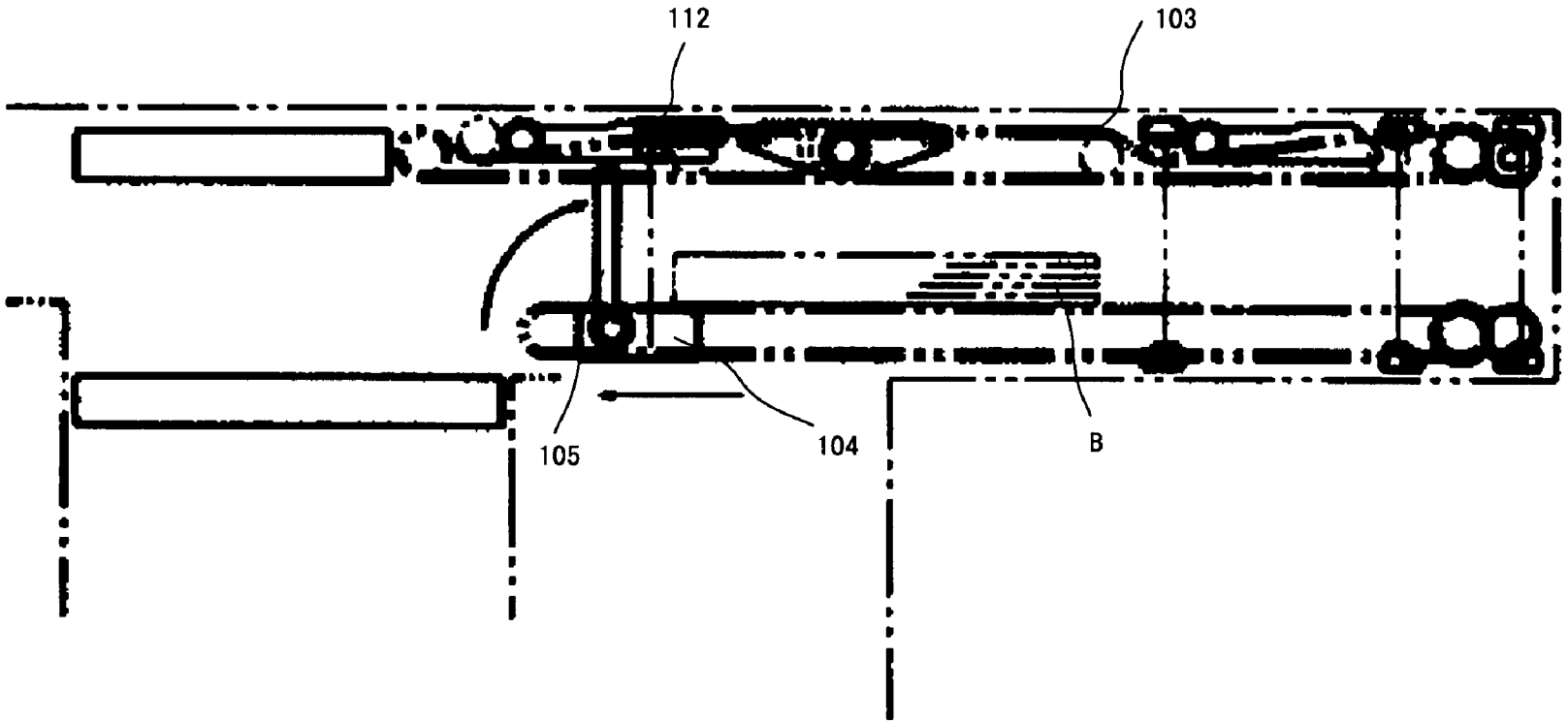
FIG. 11C is an explanatory view (3) of the operation of the pre-acceptor during the withdrawing operation.

A conveying path 305 for conveying the bundle of bills B is provided above the temporarily holding section 330. Through the conveying path 305, the bundle of bills B stored in the temporarily holding section 330 can be conveyed to the acceptor 100. The conveying operation of the bundle of bills B through the conveying path 305 is performed as a bundle using a carrier 341. The carrier 341 is used to convey the bundle of bills B by pushing the bundle of bills from behind the conveying direction as shown in FIG. 11A. By conveying the bills as described above, each of the bills bundled as the bundle of bills B is supported by the carrier 341. Therefore, the bundle of bills B is appropriately and correctly conveyed, and the projection of a bill in the cross direction to the piling direction can be completely avoided.

There are a number of gears for transmission of power to the carrier 341 on the conveying path 305. The carrier 341 moves along the guide (not shown in the attached drawings) provided on the conveying path 305 by the transmission of power from the gears. Thus, the gears for transmission of power to the carrier 341 depend on the position of the conveying path 305 of the carrier 341. The guide is also provided for the stages 331, 332, and 312.

When bills are stored only in the reservoir section, the RSV stage 331 is moved to the position (release position) on the conveying path 305. At this time, the carrier 341 has already been moved to the position (escrow evacuation position) on the rear side of the stage 331 in the release position. After the carrier 341 is moved to the position (release position) before the acceptor 100, the bundle of bills B on the stage 331 is conveyed to the slot 101 by the acceptor 100. To open the shutter, a notification is issued to the ATM when, for example, the carrier 341 is moved to the release position. The position of the carrier 341 before moving the stage 331, and the timing of issuing the notification to the carrier 341 are basically the same as in other cases.

When bills are stored only in the escrow section, the RSV stage 331 is moved to the position (upper end position) evacuated above the conveying path 305, and the ESC stage 332 is moved to the position (release position) in the conveying path 305. The bundle of bills B on the stage 332 is conveyed to the slot 101 by the acceptor 100 after the carrier 341 is moved to the position (release position) before the acceptor 100.

When bills are stored in both the reservoir section and the escrow section, the RSV stage 331 is moved to the position (release position) on the conveying path 305. At this time, the stage 312 and the pusher 313 are moved to their upper end positions. The bundle of bills B on the RSV stage 331 is carried to the stage 312 by moving the carrier 341 to the separator section 310. Next, the stage 312 is moved downward, and the pusher 313 is moved to the joint preparation position as the upper end position of the stage 312. After the pusher 313 is moved to the joint preparation position, a fork 342 shown in FIG. 1 is projected toward the pusher 313 (front). After the projection, the pusher 313 is moved to the upper end position.

Since a bill has elasticity, a folded bill is to maintain the folded state. Thus, when bills are simply piled, the height depends on the elasticity of each bill. The more the folded bills are piled, the higher the pile becomes. Thus, the fork 342 is provided to avoid the projection of the bundle of bills B on the conveying path 305.

The fork 342 is provided for evacuation from the projection state at the height of the joint preparation position along the conveying path 305. For the projection, the pusher 313 has a concave portion. Thus, after the fork 342 is projected with the pusher 313 holding the bundle of bills B on the stage 312, and the pusher 313 is moved upward, the fork 342 holds the bundle of bills B such that it cannot project on the conveying path 305.

When the carrier 341 conveys the bundle of bills B on the RSV stage 331 to the separator section 310, it returns to the escrow evacuation position. Afterwards, each of the stages 331 and 332 is sequentially moved to the upper end position. The upper end position of the ESC stage 332 corresponds to the release position of the RSV stage 331. Thus, the carrier 341 is moved, and the bundle of bills B on the ESC stage 332 is conveyed to the separator section 310.

By conveying the bills to the separator section 310, the bundle of bills B is carried to the fork 342. After the bundle of bills B is carried, the fork 342 is evacuated. Thus, on the stage 312, the bundle of bills B stored in the reservoir section and the bundle of bills B stored in the escrow section are piled in this order and bundled together. The stage 312 is moved to the upper end position, the bundled bills B conveyed to the release position of the acceptor 100 by the carrier 341, and conveyed by the acceptor 100 to the slot 101. Thus, the bills are refunded.

As described above, according to the present embodiment, the bills individually stored in the reservoir section and the escrow section are collectively refunded so that a client often fail in receive all refunded bills when they come in separate bundles. The bills left behind by the client are stored in, for example, the reject box 353.

When a client requests a transaction (deposit), the ATM instructs the paper sheet handling apparatus 1 to store the accepted bills. The bills are stored in the reservoir section of the temporarily holding section 330, the escrow section, or both of them. The paper sheet handling apparatus 1 stores the bills as follows depending on the storage position.

An abnormal bill, that is, a bill not discriminated as a normal bill, is stored in the reservoir section. Therefore, when bills are stored only in the reservoir section, the bills are refunded. The operation in this case is basically the same as in the case where bills stored only in the reservoir section are refunded at a cancellation request of a client.

When bills are stored only in the escrow section, the RSV stage 331 is moved to the upper end position for evacuation on the conveying path 305, and the ESC stage 332 is moved to the release position on the conveying path 305. Thus, the bundle of bills B on the ESC stage 332 is conveyed to the separator section 310. The bills are advanced from the conveyed bundle of bills B on a sheet by sheet basis to the separator section 310, and conveyed to the lower module 200 through the conveying path 301, the authentication section 320, and the conveying path 302.

The lower module 200 is loaded with a bill cassette 210 attachable/removable depending on the denomination of bill to be stored. An advancing mechanism 211 capable of storing a bill and advancing a stored bill is provided at the upper portion in the loaded bill cassette 210. The bills conveyed to the lower module 200 is conveyed through a conveying path 201, introduced to the bill cassette 210 for storage using a switch hook provided for the conveying path 201, and stored by the advancing mechanism 211. Thus, a bill inserted by a client is stored in the bill cassette 210 for each denomination of bill.

When bills are stored in both the reservoir section and the escrow section, the bills stored in the reservoir section are refunded to the client, and only the bills stored in the escrow section are conveyed to the separator section 310. The conveyed bills are advanced on a sheet by sheet basis to the separator section 310, and the bills discriminated as normal bills are conveyed to the lower module 200 through the conveying path 301, the authentication section 320, and the conveying path 302, and stored in the bill cassette 210 by denomination of bill. A bill discriminated as an abnormal bill is stored in the reject box 351 or 352 through the conveying path 301, the authentication section 320, the conveying path 302, and the conveying path 304. Otherwise, for example, an abnormal bill is checked again for authentication by temporarily storing the bill in the reservoir section, and then conveying it to the separator section 310.

Thus, in the present embodiment, the bundle of bills B inserted by a client is conveyed as is to the separator section 310, a bill is advanced from a bundle of bills B, a bill advanced and checked for authentication is stored in the temporarily holding section 330, and then conveyed and refunded as the bundle of bills B, or moved to the separator section 310. Therefore, as compared with the case where the bills stored after the check for authentication are advanced on a sheet by sheet basis, the conveying distance for conveying bills on a sheet by sheet basis can be shortened. Thus, the probability that a fault such as jamming, etc. occurs during convey can be reduced, thereby improving the reliability. That is, for example, the width of a Euro bill ranges from 60 mm to 86 mm. For a high-speed process, bills are to be conveyed in the direction of short sides, but a guide for regulating the position in the longitudinal direction cannot be provided. Therefore, when bills are conveyed on a sheet by sheet basis, they are held by a belt, thereby easily causing a diagonal status, etc. If they are conveyed at a low speed, the diagonal status can be reduced, but the performance is also reduced. Therefore, to convey the bills without reducing the performance, they are to be conveyed as a bundle of bills.

The advancing mechanism 311 provided for the separator section 310 has a complicated configuration with various rollers and separators. To appropriately advance bills, a mechanism for applying appropriate pressure to bills and a plurality of sensors are also to be prepared. Thus, the entire configuration is very complicated. However, by conveying to the separator section 310 the bills stored after a check for authentication as a bundle of bills B, the necessity to prepare a device such as the advancing mechanism 311 for advancing the stored bills can be avoided. By advancing bills from the same place, the common portion of the conveying path can be larger although bills are to be conveyed on a sheet by sheet basis to different destinations. As a result, the configuration of the mechanism of the entire device can be simpler, thereby reducing the production cost.

Described below in details are the operations performed during the withdrawing process. The withdrawing operation is performed by, for example, a client operating the operation section of the ATM, and requesting withdrawal of a specified amount. If a client makes the request, the ATM instructs the paper sheet handling apparatus 1 to eject bills of the specified amount of withdrawal. When the client specifies a desired bill, the paper sheet handling apparatus 1 is notified of the contents of the specification.

Upon receipt of the instruction from the ATM, the paper sheet handling apparatus 1 determines the number of sheets of bills to be advanced by, for example, the denomination of bill. According to the determination, bills are advanced on a sheet by sheet basis by the advancing mechanism 211 from the bill cassette 210. The advanced bills are conveyed to the authentication section 320 through the conveying path 201 and a conveying path 306 of the upper module 300, and checked for authentication. By the authenticating process, it is determined whether or not a bill is a normal bill to be withdrawn, and the denomination of bill is also determined. A bill determined as a normal bill is conveyed to the escrow section, and a bill determined as an abnormal bill is conveyed to the reject box 351 or 352.

Bills are conveyed to the escrow section until the bills of the client-specified amount of deposit are stored. After the bills of the specified amount of deposit are completely stored, the carrier 341 is moved to the release position before the acceptor 100 as in the case where bills only stored in the escrow section are refunded, and then the bills are conveyed to the slot 101 by the acceptor 100.

Thus, the bills handled during the withdrawing operation are also conveyed to the slot 101 of the acceptor 100 as a bundle of bills B. Therefore, the paper sheet handling apparatus 1 can be provided with a space, although it is small, reserved around the slot 101.

The acceptor 100, the lower module 200, and the upper module 300 are prepared as modules for the following reason.

It is common knowledge that the paper sheet handling apparatus used in the automated equipment such as an ATM, etc. is mounted in a cashbox. The cashbox normally depends on the automated equipment in financial facilities. Thus, the environment of mounting the paper sheet handling apparatus, for example, the position of the door for exchange of a bill cassette attached to the cashbox, the thickness of the wall of a cashbox, etc. normally depend on the automated equipment. Therefore, conventionally, the paper sheet handling apparatus applicable for the environment of each mounting condition has been designed and manufactured as necessary.

However, when the acceptor 100, the lower module 200, and the upper module 300 are designed as modules, the thickness of the wall of a cashbox can be coped with the selection of the acceptor 100. The position of the door provided for the cashbox can be coped with the change of the lower module 200 or of the direction of the movement of the bill cassette 210 stored in the lower module 200. Thus, the design based on the mounting environment is not basically required, and the necessity to the design can be avoided. As a result, the production cost of the paper sheet handling apparatus 1 can be reduced, and the manufacturer can more quickly prepare the paper sheet handling apparatus 1 to be delivered.

The configuration of the acceptor 100 is explained in detail by referring to FIGS. 2 through 5.

FIG. 2 shows the configuration of the conveying system of the acceptor 100. As shown in FIG. 2, the acceptor 100 comprises: a clamp 103 provided above the conveying path 102; a tray 104 provided below the conveying path 102; a hook 105 attached to the tray 104; a convey belt 106 for conveying the bundle of bills B along the conveying path 102; an encoder 107 for confirming the amount of convey of the bundle of bills B by the feed belt 106; sensors 109 through 112 provided at different positions on the conveying path 102; stoppers 113 and 114 provided at different positions on the conveying path 102 for projection and evacuation on the conveying path 102. A plurality of hooks 105 and the stoppers 113 and 114 are arranged in the direction normal to the convey direction of the bundle of bills B.

The encoder 107 comprises a disk 107*a* rotating with the rotation of the motor for transmitting power to the feed belt 106; and a sensor 107*b* for detecting a slit provided on circumference of the disk 107*a*. The sensor 107*b* is an optical sensor having a light emitting element and a photo receiving element. The light emitted from the light emitting element is intermittently cut off by the rotation of the disk 107*a*. Thus, a pulse signal is output from the photo receiving element, and the practical amount of convey is designated by counting the pulse signal.

The tray 104 is formed by supporting the bundle of bills B inserted from the slot 101 by a plate member. The attached hook 105 can be projected and evacuated on the conveying path 102. When the bundle of bills B is inserted, it is used as a guide having the length for insertion of the bundle of bills B as shown in FIG. 2.

About 200 bills can be collectively inserted into the slot 101. Therefore, the conveying path is designed to have the height of about 25 mm.

The tray 104 is moved along the conveying path 102 using a belt extended to superpose the feed belt 106 at the viewpoint shown in FIG. 2. To designate the amount of travel, the encoder 107 as shown in FIG. 2 is independently prepared. Relating to the stoppers 113 and 114, the stopper 113 provided at the front side is referred to as an A stopper, and the stopper 114 provided at the back side is referred to as a D stopper to avoid a mix-up.

Figure 3A:
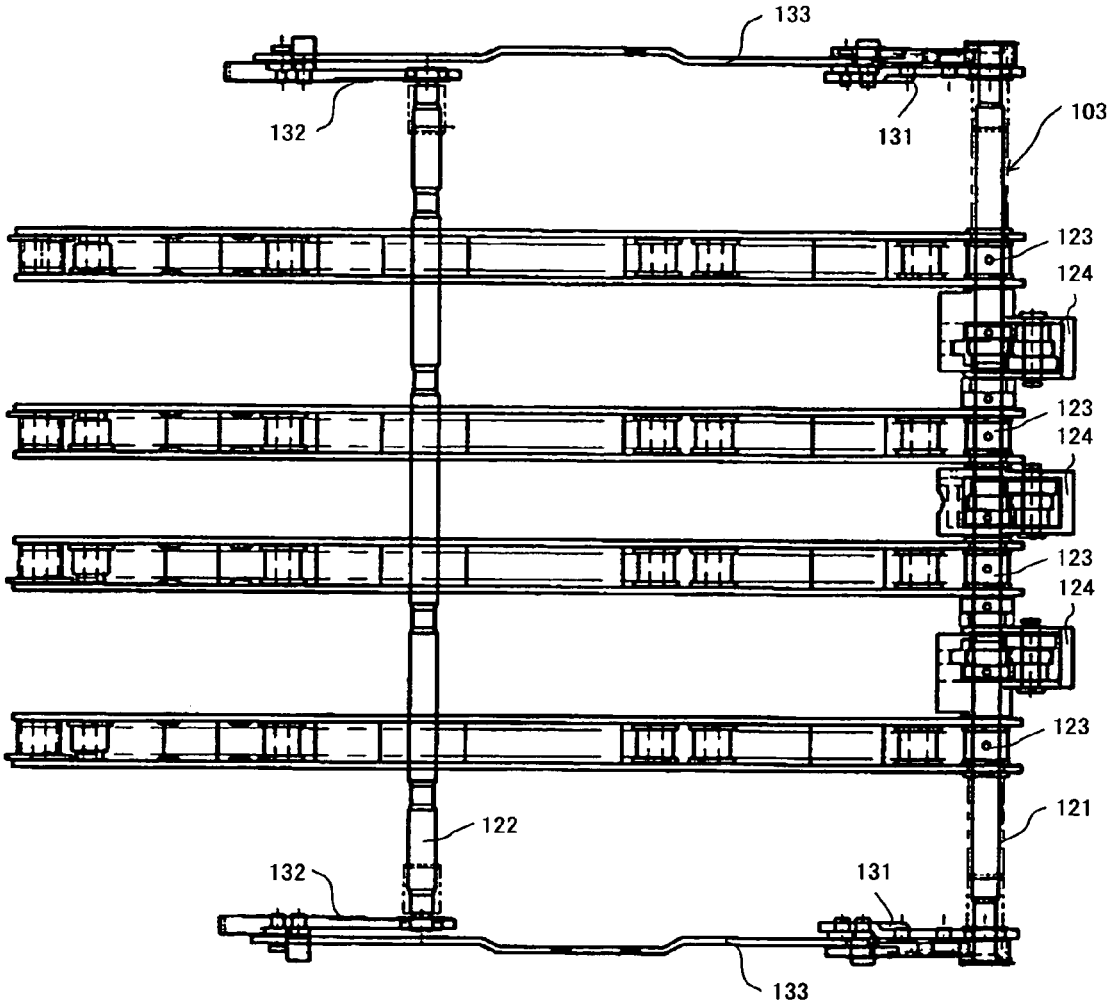
FIG. 3A is a top view for explanation of the configuration of the clamp and its drive system.
Figure 3B:
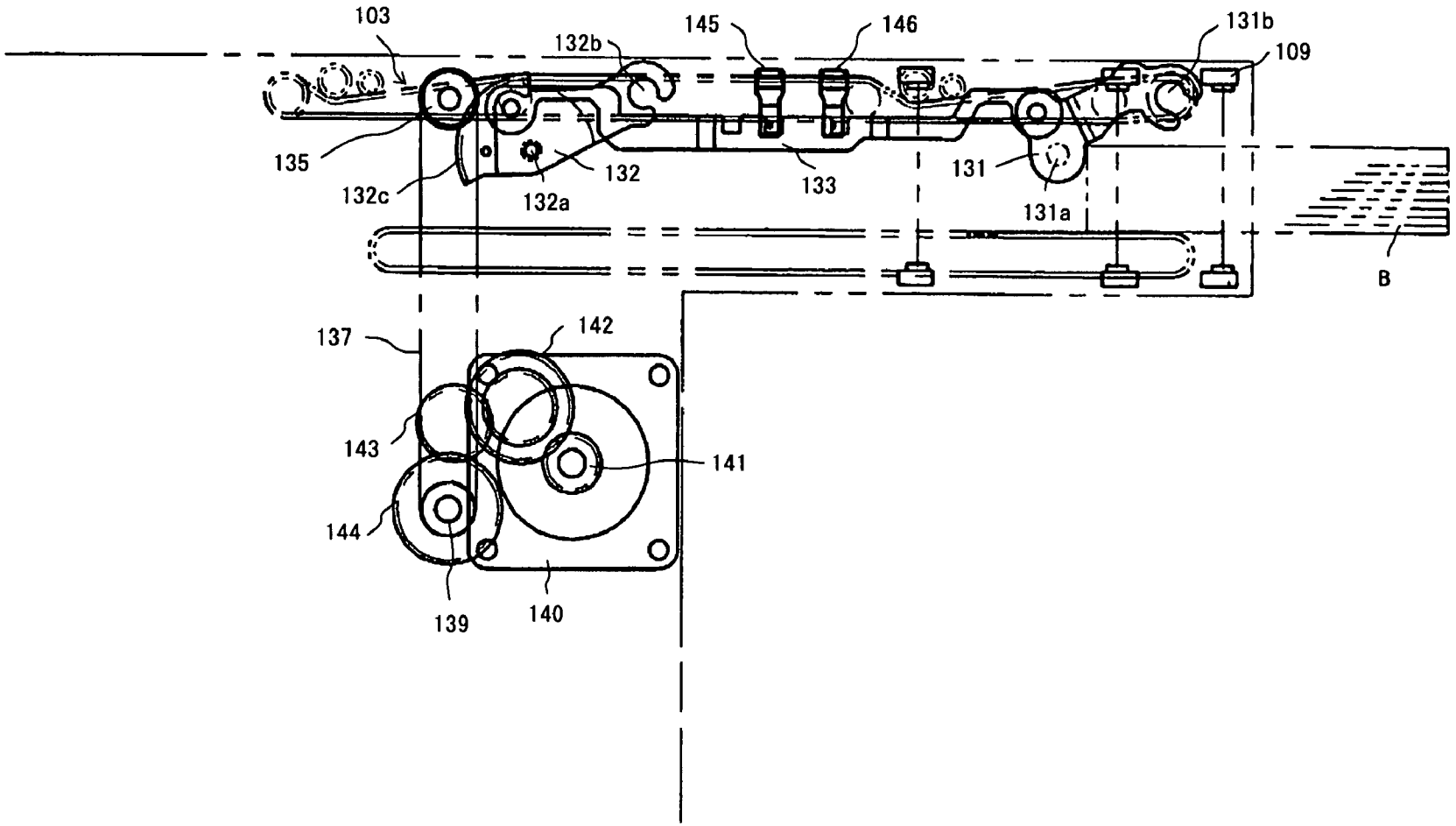
FIG. 3B is a side view for explanation of the configuration of the clamp and its drive system.
Figure 3C:
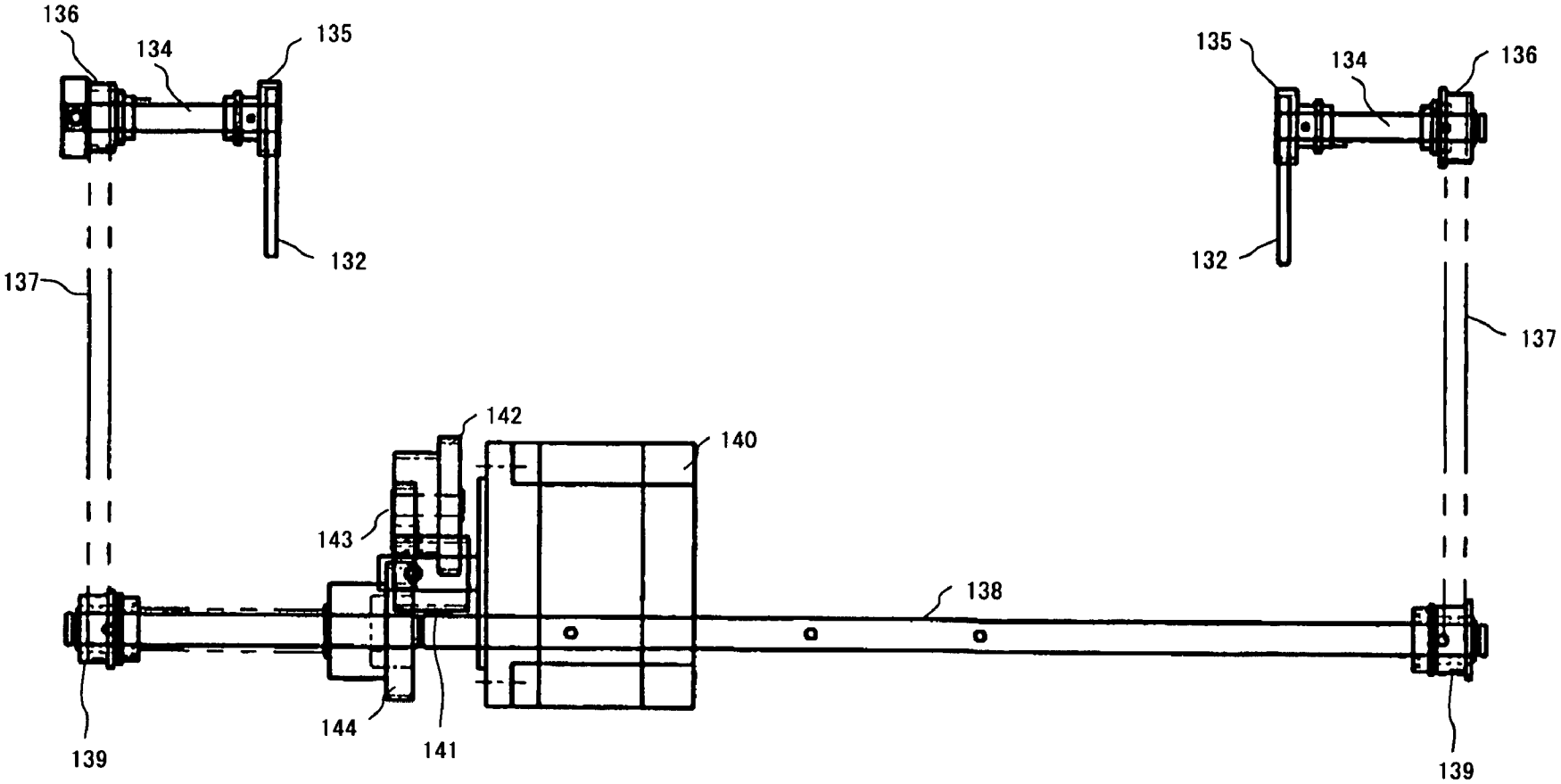
FIG. 3C is a front view for explanation of the configuration of the clamp and its drive system.

FIGS. 3A through 3C shows the configuration of the clamp 103 and its drive system. As shown in FIG. 3A, the clamp 103 is designed to have a plurality of shafts including shafts 121 and 122 hold four convey belts 123 for convey the bundle of bills B in the stretched state. A plurality of guides 124 for insertion of the bundle of bills B are attached to the shaft 121 at the front side. The power of the feed belt 123 is transmitted through a shaft, for example, the shaft 121. The power is also transmitted to the feed belt 106 arranged at the bottom.

The clamp 103 is designed to be moved in the cross direction along the conveying path 102 to pinch the inserted bundle of bills B with the tray 104. The drive system for the movement realizes the movement by arms 131 and 132 attached on both sides of the shafts 121 and 122. The power is transmitted to the arm 132, and further transmitted to the arm 131 through the link 133.

As shown in FIG. 3B, the arms 131 and 132 can be rotated on the axes 131*a* and 132*a*. The concave portions 131*b* and 132*b* are formed at both ends of them, and the shafts 121 and 122 are attached as movable on the concave portions 131*b* and 132*b*. Teeth are formed on another end portion 132*c* which is an arc-shaped portion, and the teeth are engaged in the teeth of a gear 135.

As shown in FIG. 3C, the gear 135 is attached to one end portion of a shaft 134. A pulley roller 136 is attached to the other end portion of the shaft 134. A drive belt 137 is mounted between the pulley roller 136 and a pulley roller 139 attached to the end portion of a shaft 138.

A motor 140 is a power source of a driving system for moving the clamp 103. It can be, for example, a stepping motor. The power of the motor 140 is transmitted to the shaft 138 through gears 141 through 143 and a clutch 144 as shown in FIG. 3B. The power transmitted to the shaft 138 is transmitted to the arm 132 through the roller 139, the drive belt 137, the roller 136, the shaft 134, and the gear 135. As a result of the transmission of the power, the clamp 103 can be changed from the state (upper end position) shown in FIG. 2 to the state shown in FIG. 4, and can be inversely changed from the state shown in FIG. 4 to the state shown in FIG. 2.

Figure 4:
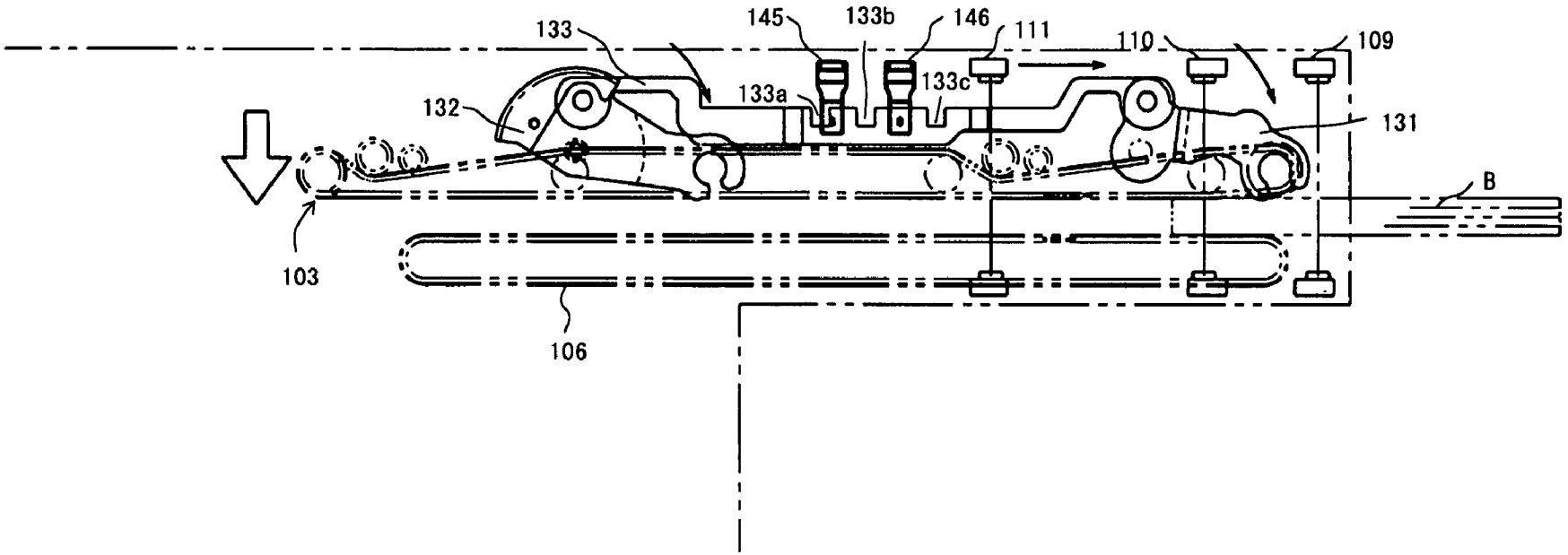
FIG. 4 is an explanatory view showing the status of the applying pressure to an inserted bundle of bills using a clamp.

By changing the state of the clamp 103 from the state shown in FIG. 2 to the state shown in FIG. 4, the pressure is applied downward to the bundle of bills B so that the bundle can be pinched between the clamp 103 and the tray 104. It is not necessary to apply excess pressure to the bundle of bills B. The height of the bundle of bills B depends on the piled bills, and the height of the bundle of bills with a sufficient pressure cannot be known in advance. Thus, in the present embodiment, a one-way clutch which does not operate with the resistance exceeding a predetermined level is used as the clutch 144, thereby correctly applying an appropriate pressure to the bundle of bills B.

The feed belt is largely transformed by the power applied from the intersection direction of the direction to apply the tension to the belt. The transform increases the change of the direction of the conveying operation of a bundle of bills, and gives the power not desired for the bundle of bills. Thus, it is very hard to apply sufficient pressure to the bundle of bills only using the feed belt. Although a higher pressure can be applied with the pulley roller for supporting the feed belt arranged at shorter intervals, it requires a larger number of parts, a complicated configuration, and an increase in production cost.

However, the tray 104 can be made of a member having sufficient rigidity. Thus, the bundle of bills can be supported in an appropriate state under the pressure. Therefore, as compared with the case in which pressure is applied with the bills pinched between the feed belts, a higher pressure can be appropriately applied. The undesired power to the bundle of bills being conveyed can be reduced. As a result the bundle of bills can be more appropriately conveyed with their state correctly maintained.

The link 133 is provided with three slits 133*a* through 133*c* as shown in FIG. 4, and also with two sensors 145 and 146 for detecting the slits 133*a* through 133*c*. The sensors 145 and 146 are optical sensors, and detect the slits 133*a* through 133*c* depending on whether or not the light emitted from the light emitting element has been cut off.

Figure 7A:
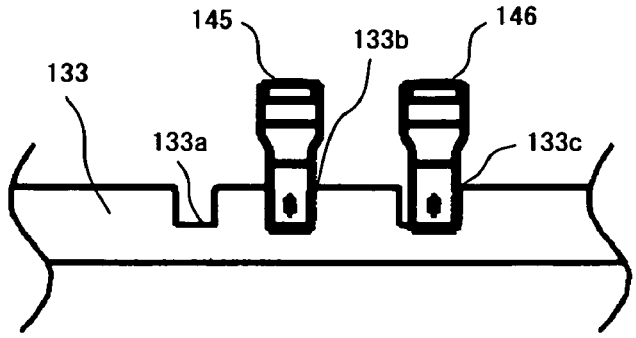
FIG. 7A is an explanatory view of the detecting method by a sensor of the height of an inserted bundle of bills (top position)
Figure 7B:
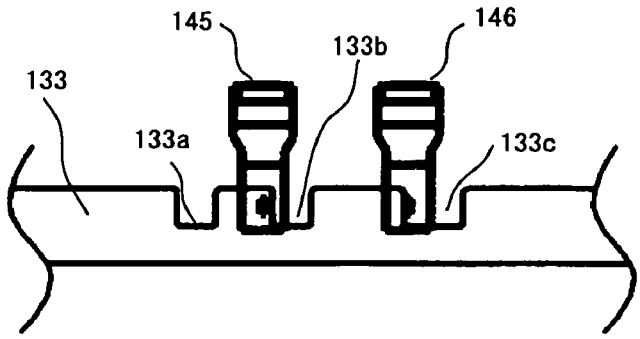
FIG. 7B is an explanatory view of the detecting method by a sensor of the height of an inserted bundle of bills (enabled position 1)
Figure 7C:
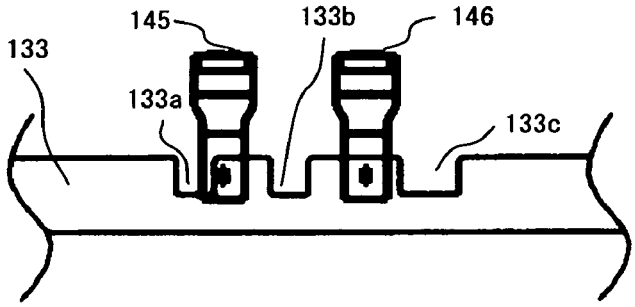
FIG. 7C is an explanatory view of the detecting method by a sensor of the height of an inserted bundle of bills (acceptance enabled position 2)
Figure 7D:
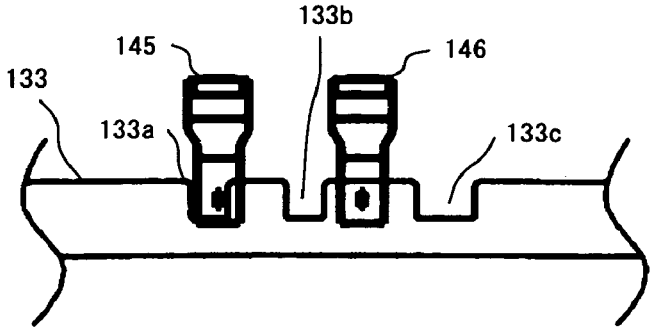
FIG. 7D is an explanatory view of the detecting method by a sensor of the height of an inserted bundle of bills (lower end position)

The slits 133*a* through 133*c* and the sensors 145 and 146 are arranged such that it can be determined the position of the clamp 103 and whether or not the height of the bundle of bills B for reception. Thus, if the clamp 103 is positioned at the upper end as shown in FIG. 2, the light passes through each of the sensors 145 and 146, that is, the light from the light emitting element can enter the photo receiving element as shown in FIG. 7A. If the bundle of bills B is at the appropriate height for reception, the sensor 145 cuts off the light, that is, prevents the light from the light emitting element from entering the photo receiving element as shown in FIG. 7B or 7C. At this time, the other sensor 146 can either cut off or pass the light. If there is no bundle of bills B or the bundle of bills B is very low, the sensor 145 passes the light, and the sensor 146 cuts off the light as shown in FIG. 7D. When the state shown in FIG. 7D occurs, the clamp 103 is positioned at the lower end.

Figure 5:
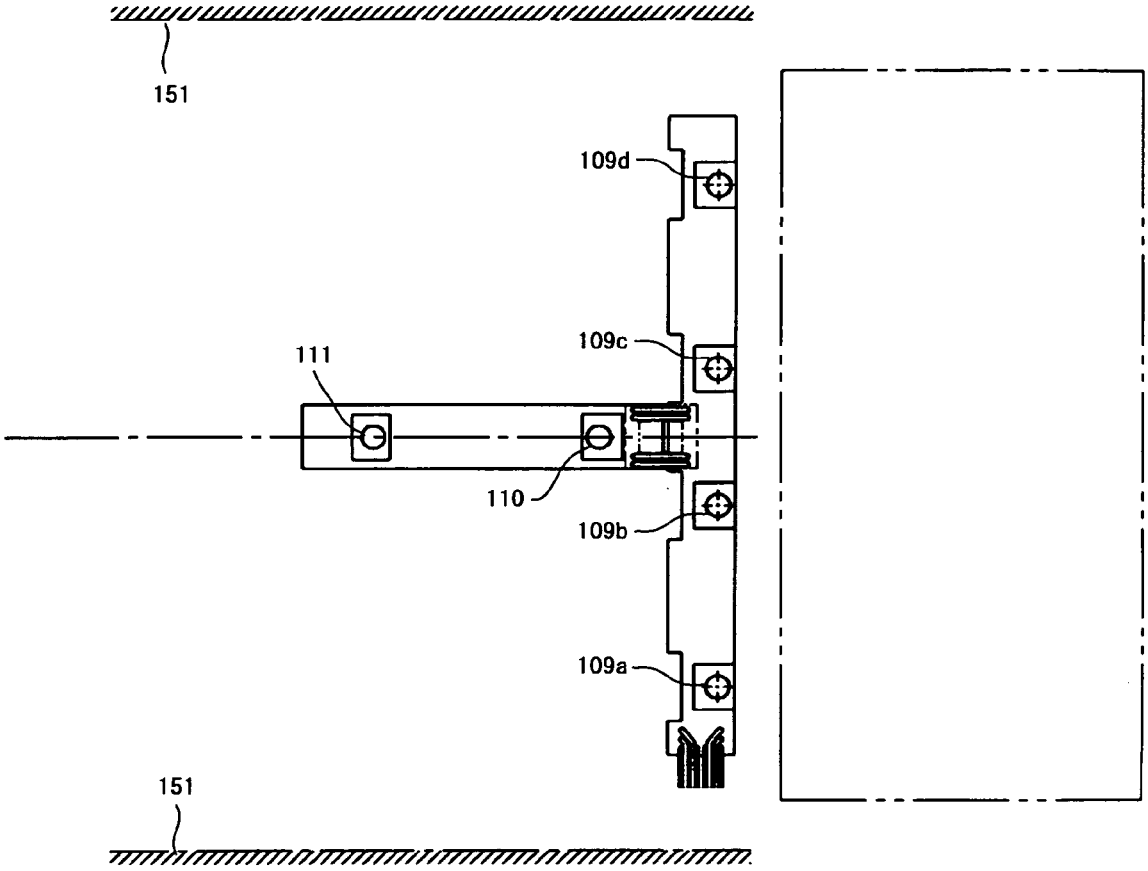
FIG. 5 is an explanatory view showing the arrangement of a sensor provided near a slot.
Figure 8A:
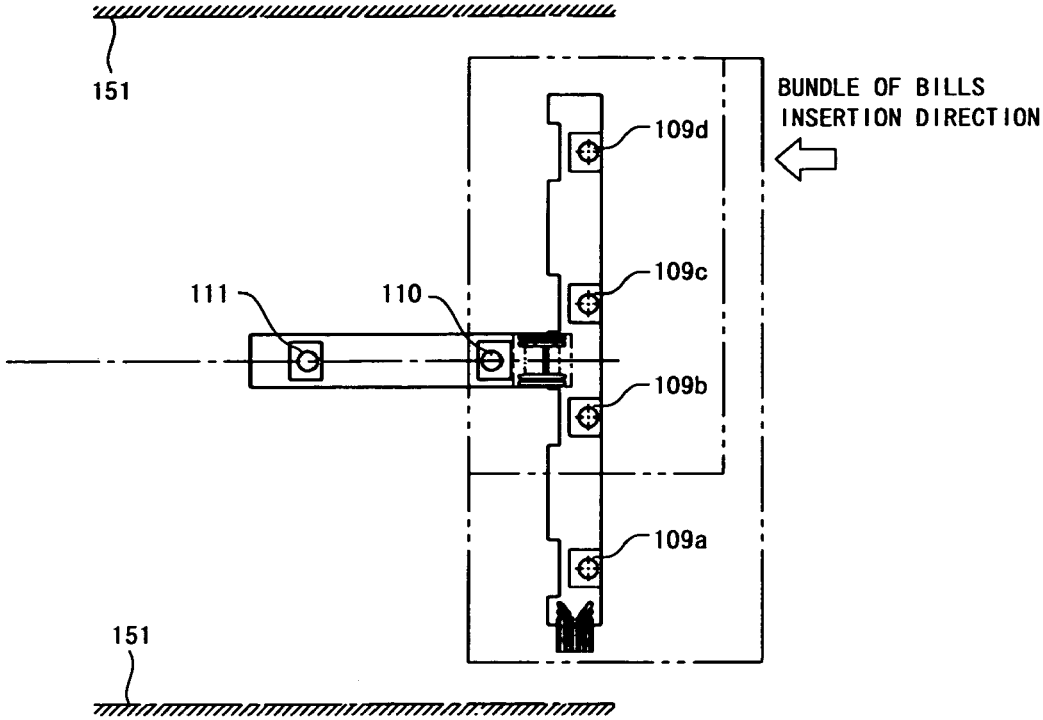
FIG. 8A is an explanatory view of the bundle of bills satisfying the acceptance condition.
Figure 8B:
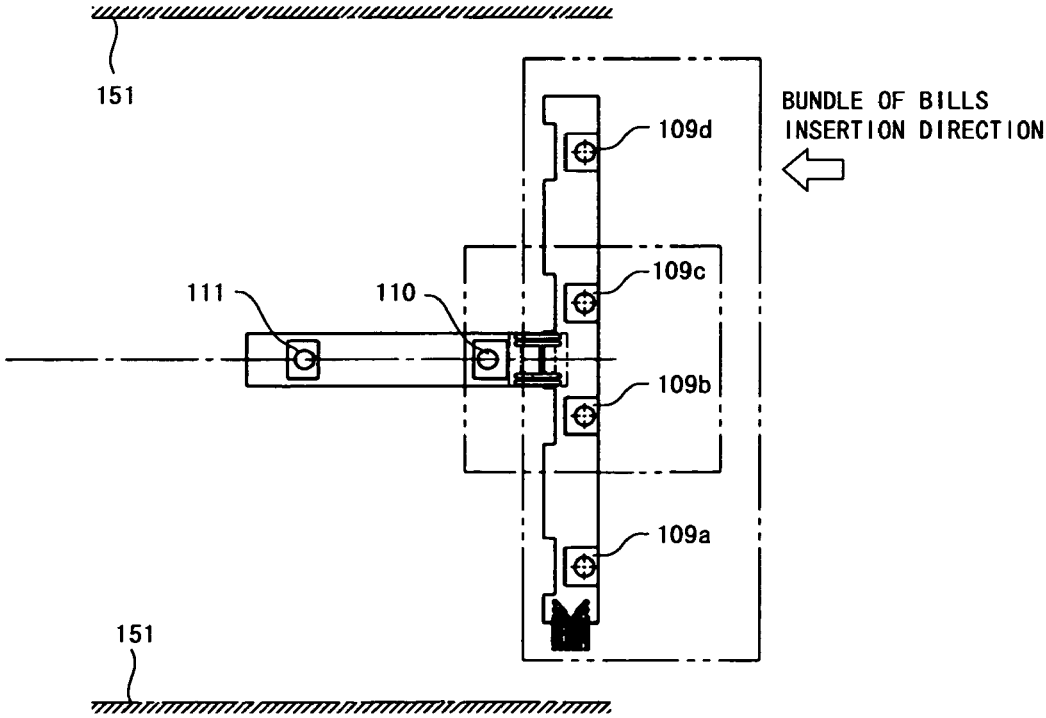
FIG. 8B is an explanatory view of the bundle of bills not satisfying the acceptance condition.

FIG. 5 is an explanatory view of the arrangement of the sensor provided near the slot 101. The sensors 109 through 111 provided near the slot 101 and the sensor 112 provided at the back side are optical sensors The bundle of bills B is inserted between a width adjustment guides 151 horizontally, that is, with the longitudinal direction of the bills crossing the insertion direction as shown in FIG. 5. Four sensors 109*a* through 109*d* are arranged as sensors 109 so that it can be determined whether or not the width (length of the long side) of the bundle of bills B inserted into the slot 101 is normal. Using the sensors 109*a* through 109*d* and the sensor 110, it is determined whether or not the bundle of bills B is to be fetched. The fetching condition for the bundle of bills B to be fetched is to detect the bundle of bills B by the sensors 109*b* and 109*c* and to further detect the bundle of bills B by any of the sensors 109*a* and 109*d* as shown in FIG. 8A. When the bundle of bills B does not satisfy the condition as shown in FIG. 8B, the intake of the bundle is rejected.

The bundle of bills B may be inserted into the slot 101 in the diagonal status. The diagonal status is detected using the sensors 109*b* and 109*c* only on the bundle of bills B which satisfies the fetching condition.

Figure 9:
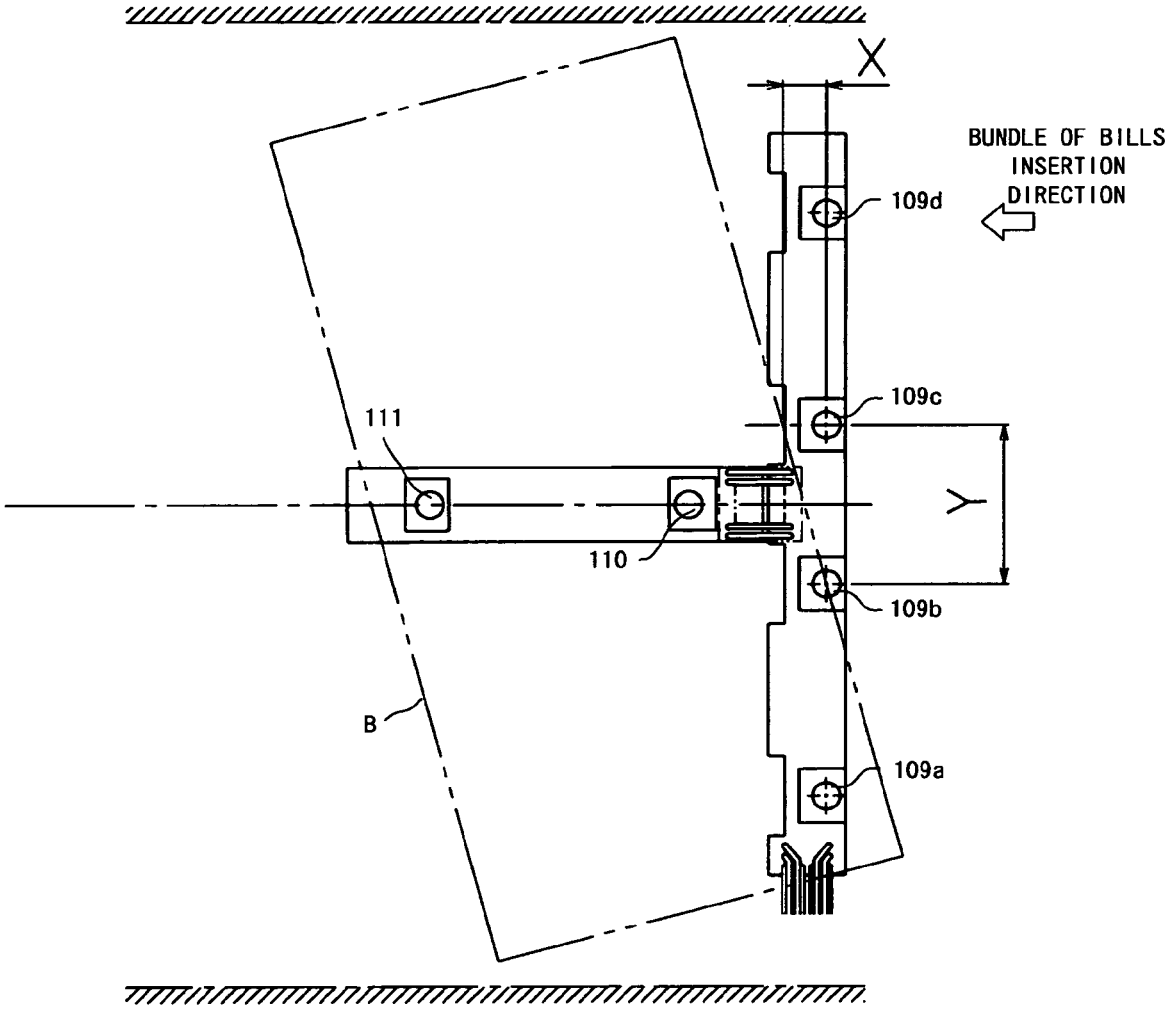
FIG. 9 is an explanatory view of the diagonal level measuring method for a bundle of bills.

If the bundle of bills B is in the diagonal status, and it is conveyed inside, there can be a shift in timing with which the sensors 109*b* and 109*c* stop detection. If the time difference is $\Delta T$ and the conveying speed is V, the amount of shift X between the sensors 109*b* and 109*c* shown in FIG. 9 is expressed as follows.

$$X=V\cdot\Delta T$$

Therefore, the diagonal level θ (°) is calculated as follows with the distance between sensors 109*b* and 109*c* defined as Y.

$$\theta=\tan^{-1}(X/Y)$$

Only when the diagonal level θ is within the allowance, the bundle of bills B is continuously fetched.

As described above, the length of the long side of the bundle of bills B is checked using the sensors 109*a* through 109*d*. The length of the short side of the bundle of bills B is checked by confirming whether or not the length of the conveying operation from the position where the conveyed bundle of bills B starts cutting off the light on the sensor 111 to the position where the cutoff is released. The height of the bundle of bills B is measured by counting the amount of rotation of the motor 140 required to first pressing the clamp 103 and then returning it to the upper end position.

At the upper end position, the sensors 145 and 146 both pass the light as shown in FIG. 7A. Therefore, by the sensors 145 and 146 monitoring the output signal, the height from the position where the bundle of bills B is pressed to the upper end position can be designated. Thus, the height of the bundle of bills B can be calculated by subtracting the designated height from the height between the clamps 103 at the upper end position and the tray 104.

Thus, in the present embodiment, the sizes of the bundle of bills B (lengths of the long and short sides) are checked, the diagonal level θ and the height are measured by the acceptor 100. Thus, an inappropriate bundle of bills B is returned to the client at the earlier stage to realize higher use efficiency. The explanation of the operation to realize the high use efficiency is described later.

Figure 6:
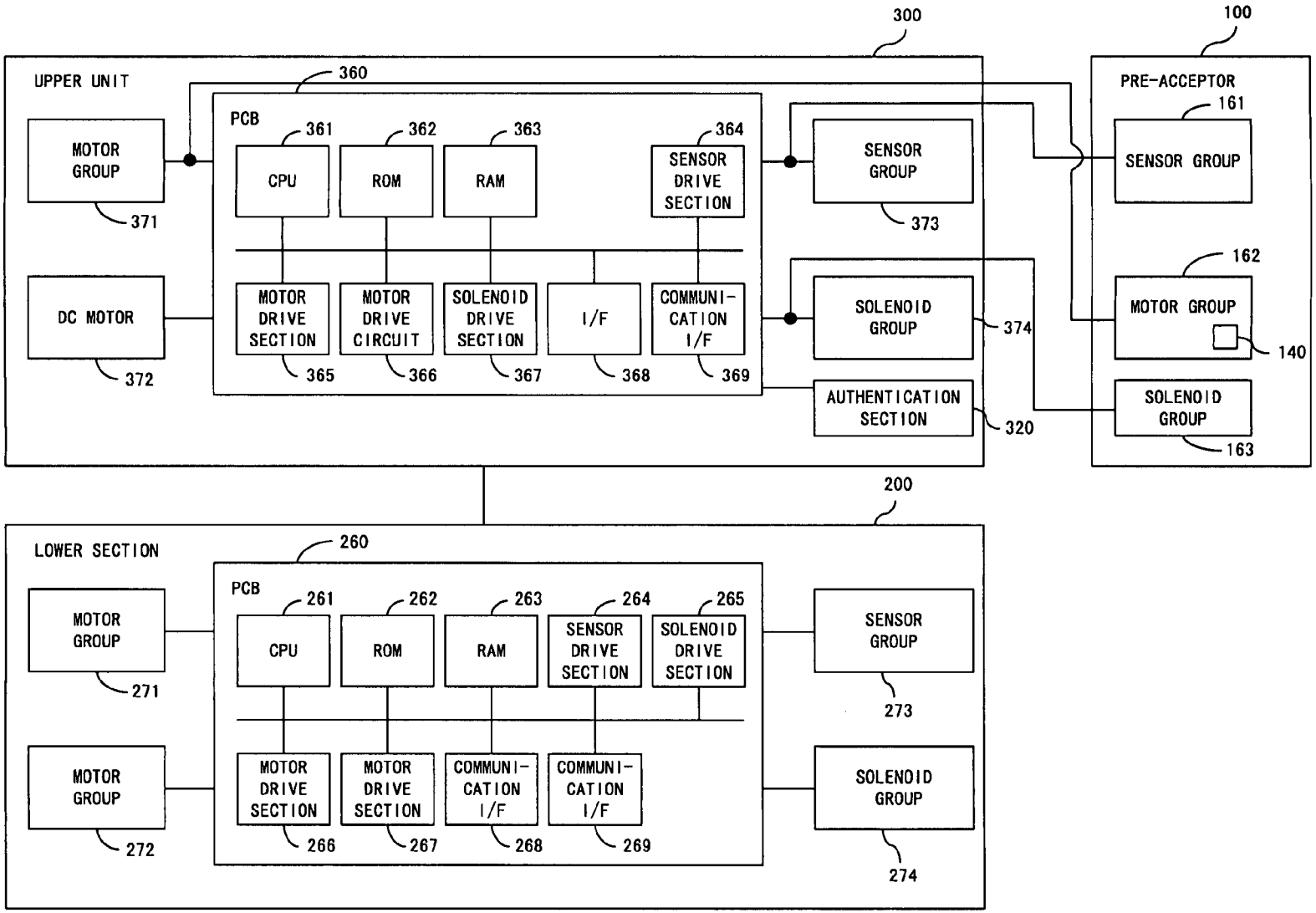
FIG. 6 shows the configuration of the circuit of the paper sheet handling apparatus according to an embodiment of the present invention.

FIG. 6 shows the configuration of the circuit of the paper sheet handling apparatus 1.

The acceptor 100 is provided with a sensor group 161, a motor group 162, and a solenoid group 163. The sensor group 161 comprises sensors 109 through 112, 145, 146, and the sensor 107*b* of the encoder 107, etc. The motor group 162 comprises the motor 140 which is a power source for the travel of the clamp 103, the feed belt 123 attached on the clamp 103, the driving motor of the feed belt 106 attached below the belt 123, and the traveling motor of the tray 104. The motors are all stepping motors. The projection and evacuation of the hook 105, the A stopper 113, and the D stopper 114 are performed using solenoids. The solenoid group 163 comprises the solenoids.

The lower module 200 is operated by the control of a printed circuit board (PCB) 260. Motor groups 271 and 272, a sensor group 273, and a solenoid group 274 are connected to the printed circuit board 260.

The motor group 271 comprises, for example, a plurality of stepping motors. Each stepping motor is used as a power source for the travel of the stage provided in the corresponding bill cassette 210. The motor group 272 comprises, for example, a plurality of DC motors. Each DC motor is used as a power source of the advancing mechanism 211 provided in the corresponding bill cassette 210.

The sensor group 273 comprises a plurality of sensors provided for detecting a bill on the conveying path 201, a plurality of sensors (for example, a plurality of switches) for detecting the bill cassette 210, a plurality of sensors for detecting the position of the stage of the bill cassette 210, a sensor for detecting a stored bill, etc. The solenoid group 274 comprises a solenoid for switching the status prepared for each switch hook on the conveying path 201, a solenoid for transmitting the power to the advancing mechanism 211 prepared in each bill cassette 210, etc.

The printed circuit board 260 is loaded with: a CPU 261 for controlling the entire paper sheet handling apparatus 1; ROM 262 storing a program executed by the CPU 261 and various control data; RAM 263 used for work by the CPU 261; a sensor drive section 264 for driving a sensor forming part of the sensor group 273; a solenoid drive section 265 for individually driving the solenoid forming part of the solenoid group 274; a motor drive section 266 for driving the stepping motor forming part of the motor group 271; a motor drive section 267 for driving the DC motor forming part of the motor group 272; a communication interface (I/F) 268 for communication with, for example, the upper module 300; and a communication I/F 269 for communication with an upper device such as the ATM.

The upper module 300 is operated by the control of a printed circuit board 360. Motor groups 371 and 162, DC motors 372, sensor groups 373 and 161, solenoid groups 374 and 163, and the authentication section 320 are connected to the printed circuit board 360. Thus, the acceptor 100 is controlled by the upper module 300.

The motor group 371 comprises, for example, a plurality of stepping motors. The carrier 341, each of the stages 312, 331, and 332, and the pusher 313 are moved by the respective stepping motors as power sources. The DC motor 372 is a power source for advancing bills from the separator section 310 and conveying them.

The sensor group 373 comprises a plurality of sensors provided for each of conveying paths 301 through 305 for detecting a bill or a carrier 341, a plurality of sensors provided for the separator section 310, a plurality of sensors provided for the temporarily holding section 330, etc. The solenoid group 374 comprises the switch hooks 302*a* and 302*b* on the conveying path 301, and a solenoid for switching the status of the switch hook provided on other conveying paths 303 and 304.

The printed circuit board 360 is loaded with: a CPU 361 for controlling the entire upper module 300; ROM 362 storing a program executed by the CPU 361 and various control data; RAM 363 used for work by the CPU 361; a sensor drive section 364 for driving the sensor forming part of the sensor groups 373 and 161; a motor drive section 365 for driving the stepping motor forming part of motor groups 371 and 162; a motor drive circuit 366 for driving the DC motor 372; a solenoid drive section 367 for individually driving the solenoid forming part of the solenoid groups 374 and 163; an interface (I/F) 368 for transmitting/receiving a signal to and from the authentication section 320; and a communication I/F 369 for communication with the lower module 200.

The operation with the above-mentioned configuration is explained below.

The CPUs 261 and 361 on each of the printed circuit boards 260 and 360 perform control by respectively executing the programs stored in the ROM 262 and 362. The CPU 261 receives an instruction from the ATM through the communication I/F 269, performs control of the lower module 200 according to the instruction, and issues an instruction to the upper module 300. The instruction is transmitted to the CPU 361 of the upper module 300 through the communication I/F 268 and 369.

The CPU 261 receives from the sensor drive section 264 at any time various detection results obtained by allowing the sensor drive section 264 to drive the sensor group 273, and receives from the communication I/F 268 or 269 the contents communicated from the upper module 300 or the ATM. It also issues an instruction to the solenoid drive section 265 and the motor drive sections 266 and 267 depending on the respective situations by analyzing the detection results and the communication contents. Thus, the lower module 200 is operated under the control of the CPU 261. Furthermore, the information to be communicated is transmitted at any time through the communication I/F 268 or 269.

The CPU 361 of the other upper module 300 controls the upper module 300 and the acceptor 100 at an instruction from the lower module 200. The control is performed by receiving from the sensor drive section 364 at any time various detection results obtained by allowing the sensor drive section 364 to drive the sensor groups 373 and 161, analyzing the results, and issuing an instruction depending on the respective situations to the solenoid drive section 367, the motor drive section 365, the motor drive circuit 366, and the authentication section 320. Thus, the upper module 300 and the acceptor 100 are operated under the control of the CPU 361. The instruction to the authentication section 320 is given to the interface 368, and the information to be given to the lower module 200 is transmitted at any time through the communication I/F 369. When the bundle of bills B inserted by a client is fetched, the deposit amount is transmitted, and when bills are stored, the denomination of bill discriminated as a normal bill is transmitted as information to the lower module 200.

Hereafter, the operations of the paper sheet handling apparatus 1 are explained in detail by referring to the flowcharts shown in FIGS. 12 through 17 and the explanatory views shown in FIGS. 10A through 10G and 11A through 11F. The operations are realized by the CPU 261 of the lower module 200 controlling the lower module 200, and the CPU 361 of the upper module 300 controlling the upper module 300 and the acceptor 100 under the control of the CPU 261. FIGS. 10A through 10G are explanatory views of the operation of the acceptor 100 during the depositing operation. FIGS. 11A thorough 11F are explanatory views of the operations during the withdrawing operation (including refunding operation).

Figure 12:
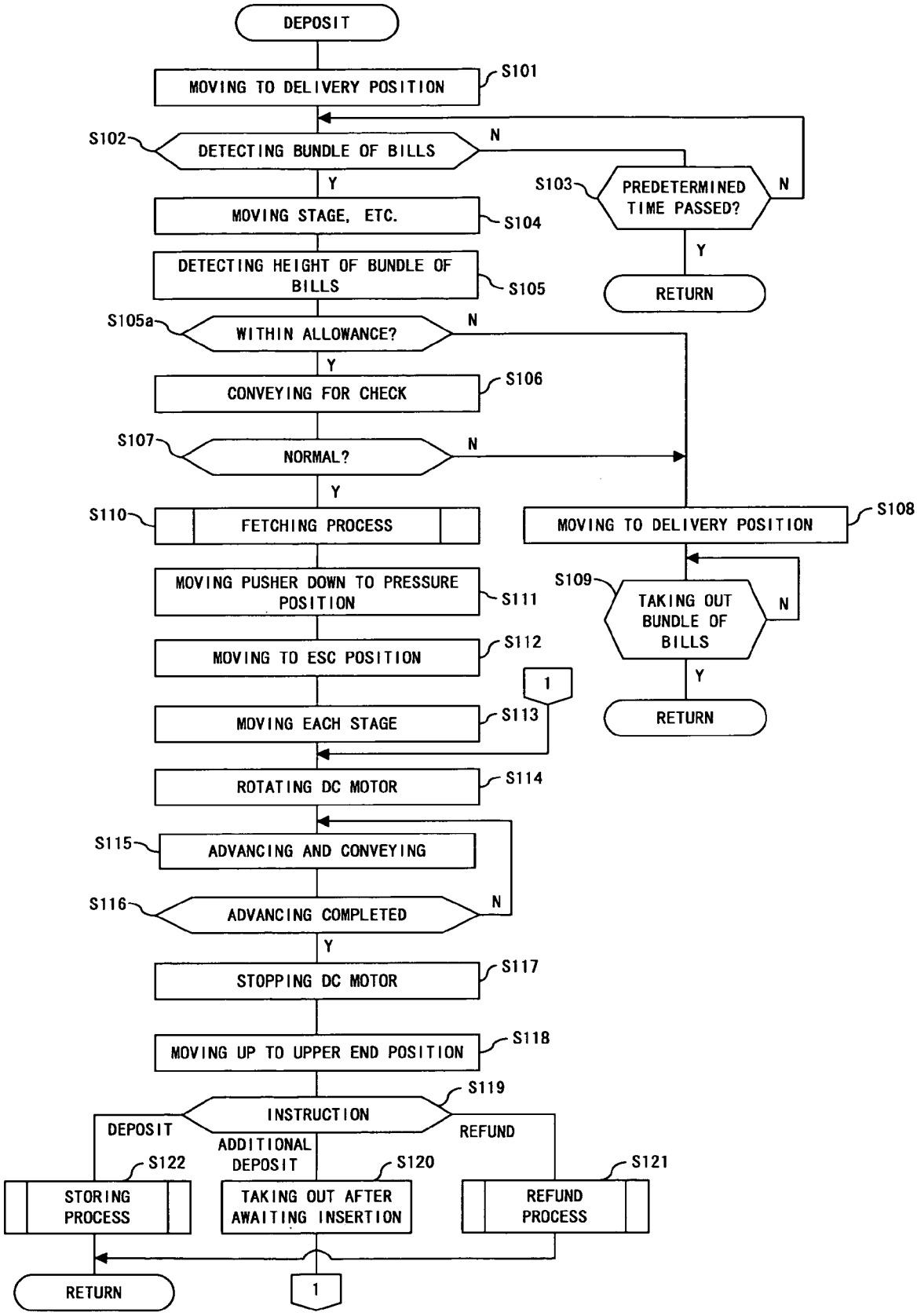
FIG. 12 is a flowchart of the depositing process.

FIG. 12 is a flowchart of the depositing process. The process is performed at an instruction of the ATM to realize the deposit requested by a client. First, by referring to FIG. 12, the depositing operation is explained in detail.

Each section of the lower module 200 is operated under the control of the CPU 261, and each section of the upper module 300 and acceptor 100 operates by the control of the motor group 371. Thus, the following explanation is given by considering the CPU which controls a target to be operated.

Figure 10A:
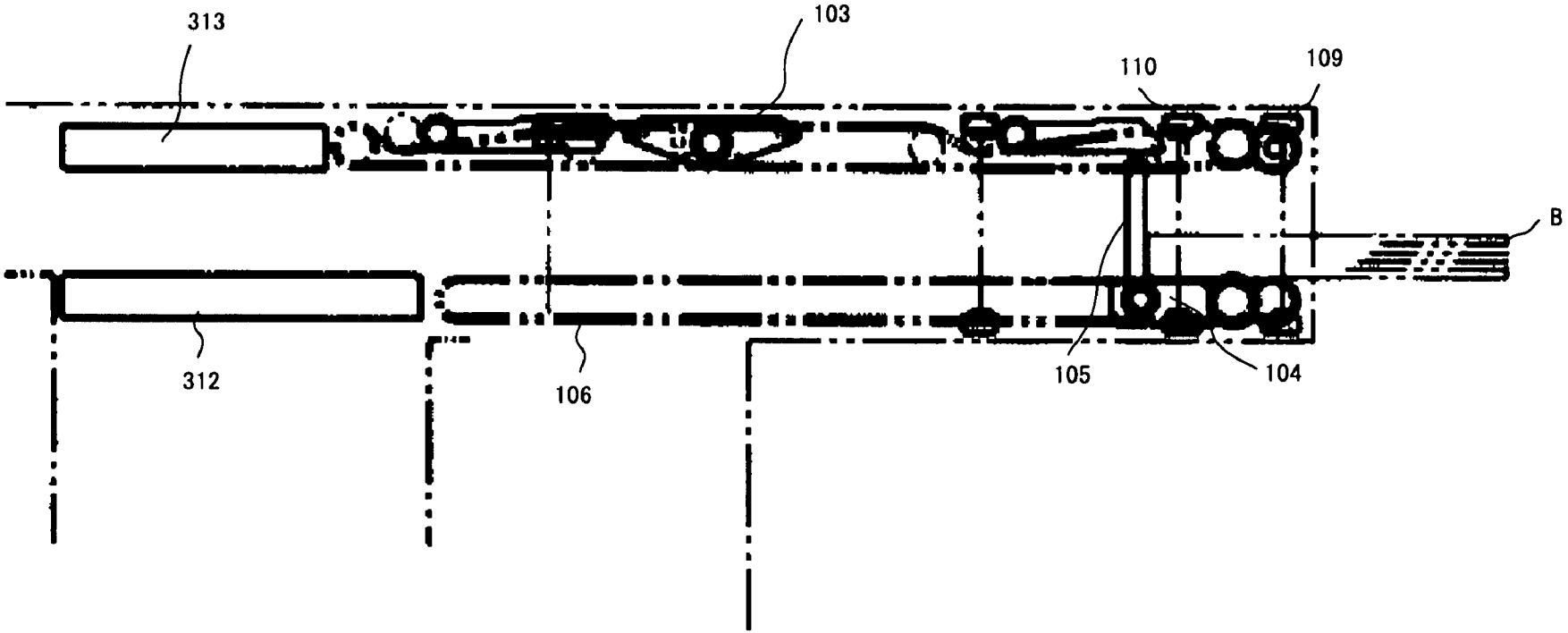
FIG. 10A is an explanatory view (1) of the operation of the pre-acceptor during the depositing operation.

First, in step 101, it is confirmed whether or not the tray 104 is located in the delivery position shown in FIGS. 2 and 10A. If it is not located in the delivery position, it is moved to the position. In the next step 102, it is determined whether or not a bill satisfying the fetching condition (FIG. 8A) has been detected in the slot 101. When the bundle of bills B inserted by the client into the slot 101 satisfies the fetching condition, the determination is YES, and control is passed to step 104. Otherwise, the determination is NO, and control is passed to step 103. To satisfy the fetching condition means that the length of the long side of the bundle of bills B is within the allowance.

The processes in steps 101 and 102 are realized by the control of the CPU 361 of the upper module 300 for which the CPU 261 of the lower module 200 indicates fetching the bundle of bills B. The steps 103 through 118 described later are similarly performed. The shutter provided near the slot 101 is opened after the process in step 101 is performed. The hook 105 is normally projected.

In step 103, it is determined whether or not a predetermined time has passed since the detection of the bundle of bills B started. When the predetermined time has passed, the determination is YES, thereby terminating a series of processes. Otherwise, the determination is NO, and control is returned to step 102. Thus, the insertion of the bundle of bills B is awaited until a predetermined time passes.

Although not specifically shown in the attached drawings, the CPU 361 notifies the CPU 261 that the bundle of bills B is not inserted at the stage before the determination in step 103 is YES. The information is also transmitted from the CPU 261 to the ATM. By issuing the notification with the timing, the determination in step 103 is YES after the ATM closes the shutter.

Figure 10B:
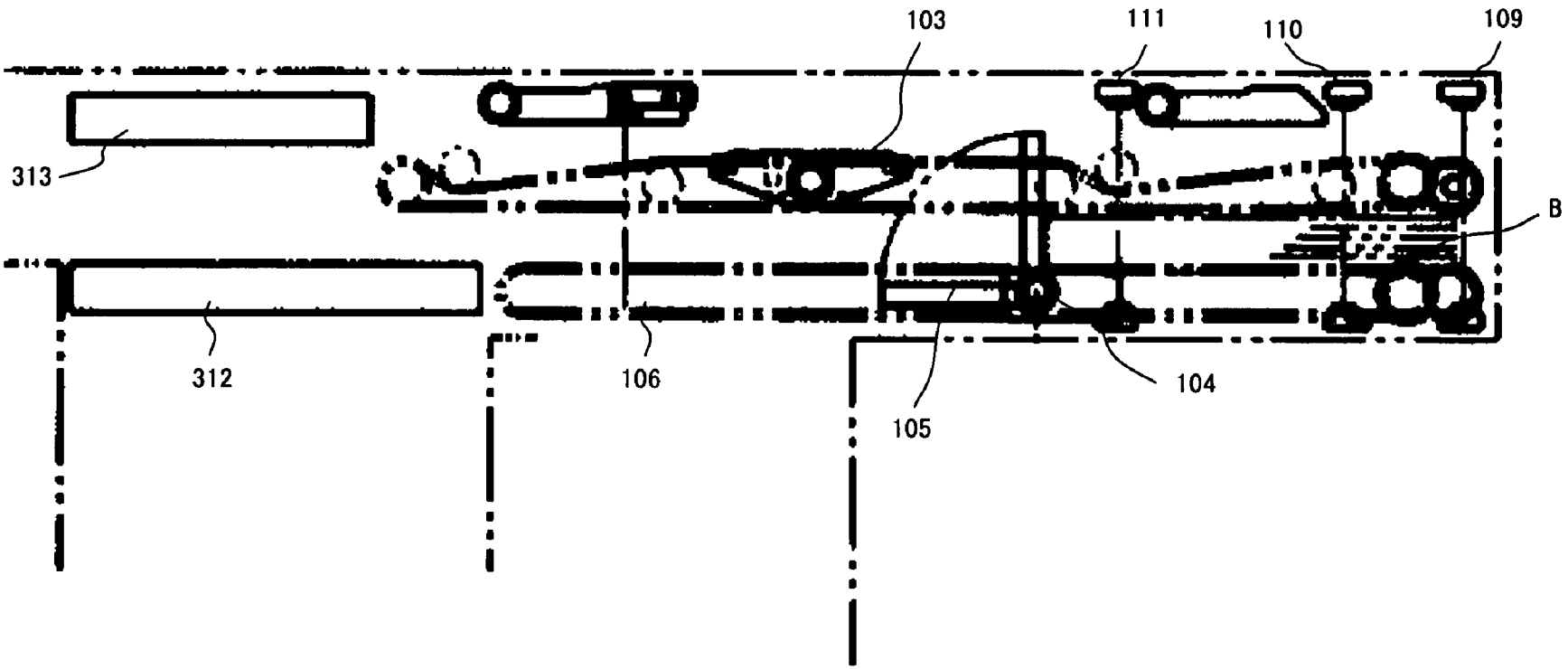
FIG. 10B is an explanatory view (2) of the operation of the pre-acceptor during the depositing operation.

On the other hand, in step 104, the carrier 341 is move to the delivery position shown in FIG. 1OF as the position where the bundle of bills B is conveyed to the separator section 310, and the pusher 313 and the stage 312 are moved to the upper end position shown in FIG. 10A. In the next step 105, the motor 140 is driven to apply the pressure by the clamp 103 as shown in FIG. 10B, and the sensors 145 and 146 detect the height of the bundle of bills B (refer to FIGS. 4, and 7A through 7D). The motor 140 as a stepping motor is driven by indicating the driving operation of the motor by the CPU 361 notifying the motor drive section 365 of the rotation direction and the number of pulses (number of steps). The same process is performed on other stepping motors.

In the next step 105*a*, it is determined whether or not the height is within the allowance. When the height of the bundle of bills B permits fetching, the sensor 145 changes from the state in which it passes the light to the state in which it cuts off the light while the clamp 103 is moved down to apply the pressure as shown in FIGS. 7A through 7D. When the change does not occur, it is determined NO because the height of the bundle of bills B is not within the allowance, thereby passing control to step 108. Otherwise, the determination is YES, thereby passing control to step 106.

In step 106, as shown in FIG. 10B, after evacuating the hook 105, the power is transmitted to the feed belts 106 and 123, and the tray 104, and a conveying operation is performed to check the length of the short side of the bundle of bills B. The conveying operation is performed on the maximum length in the allowance after the sensor 111 detects the bundle of bills B. When the conveying operation is performed, the time difference between the sensors 109*b* and 109*c* not detecting the bundle of bills B is timed and calculates the diagonal level from the time difference to check the diagonal status (FIG. 9). The hook 105 is evacuated by the CPU 361 specifying the solenoid drive section 367 and driving the solenoid for evacuating it. This process is also performed on other solenoids. The actual amount of travel is confirmed by monitoring the signal output by the sensor 107*b* of the encoder 107. The length of the long side of the bundle of bills B is checked in step 102 as described above.

In step 107 after step 106, it is determined whether or not the bundle of bills B is normal, that is, the length of the short side of the bundle of bills B, and the diagonal level θ are both within the allowance. If they are within the allowance, the determination is YES and control is passed to step 110. Otherwise, that is, when at least one of the lengths of the short side and the diagonal level θ is not within the allowance, the determination is NO, and control is passed to step 108.

In step 108, after the tray 104 is moved to the delivery position (refer to FIG. 10A) with the pressure by the clamp 103, the pressure is released. After the release of the pressure, control is passed to step 109, and fetching the bundle of bills B is awaited. When the sensors 109*a* through 109*d* enter the state in which they do not detect the bundle of bills B, it is determined that the bundle of bills B has been fetched, and the notification is transmitted from the CPU 361 to the CPU 261, and from the 261 to the ATM, thereby terminating a series of processes.

If the bundle of bills B is continuously detected even after a predetermined time although not shown in the attached drawings, then it is determined that the client forgot taking the bundle of bills B, the bundle of bills B is fetched inside, and stored in the reject box 353. Thus, the unavailable state of the ATM due to forgetting taking bills by a client can be avoided.

In step 110 in which the determination in step 107 is YES and to which control is passed, the fetching process for convey of the bundle of bills B to the separator section 310 is performed. By performing the fetching process, the bundle of bills B is conveyed to the stage 312 as shown in FIG. 10G. Afterwards, control is passed to step 111.

Figure 13:
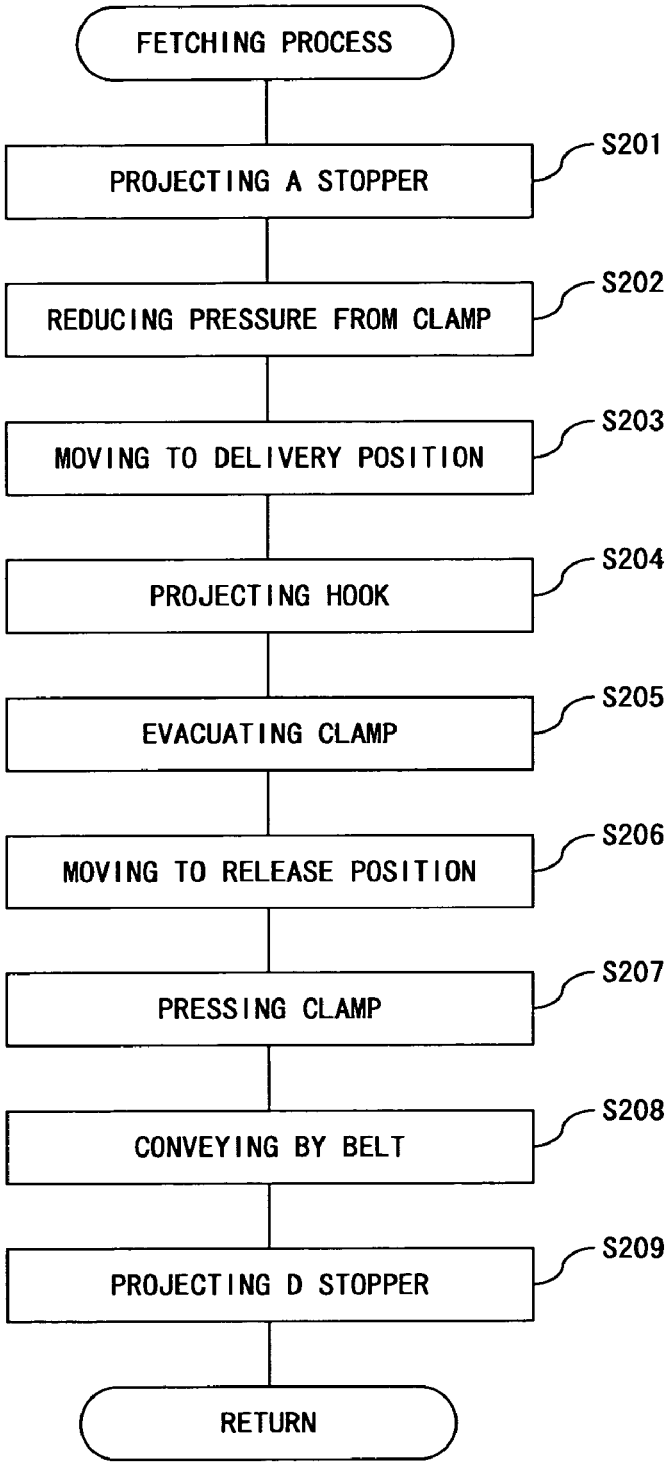
FIG. 13 is a flowchart of the accepting process.

The fetching process is explained in detail by referring to the flowchart shown in FIG. 13. The statuses shown in FIGS. 10C through 10G of the acceptor 100 are realized by performing the fetching process. When the fetching process is started, the front end of the bundle of bills B is behind the position (FIG. 2) where the sensor 111 detects the bundle of bills.

Figure 10C:
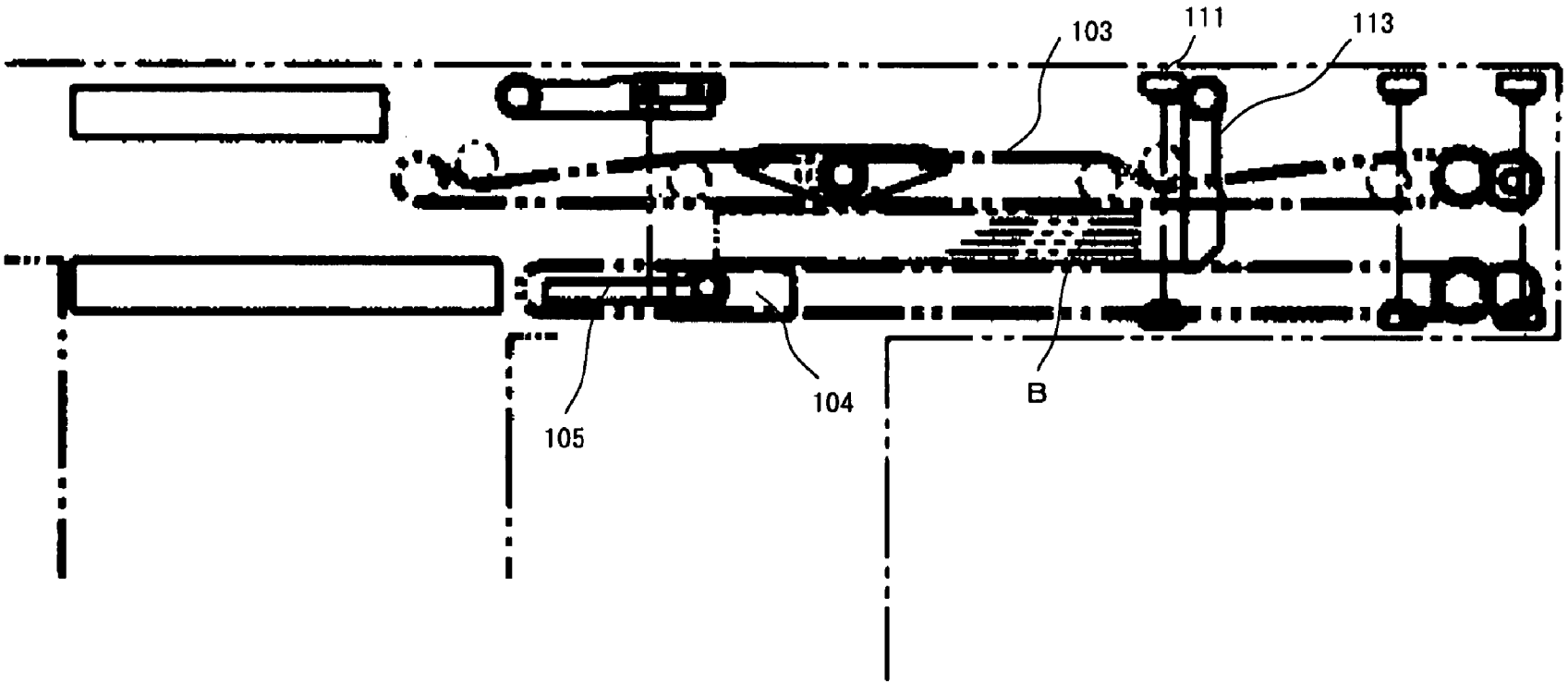
FIG. 10C is an explanatory view (3) of the operation of the pre-acceptor during the depositing operation.
Figure 10D:
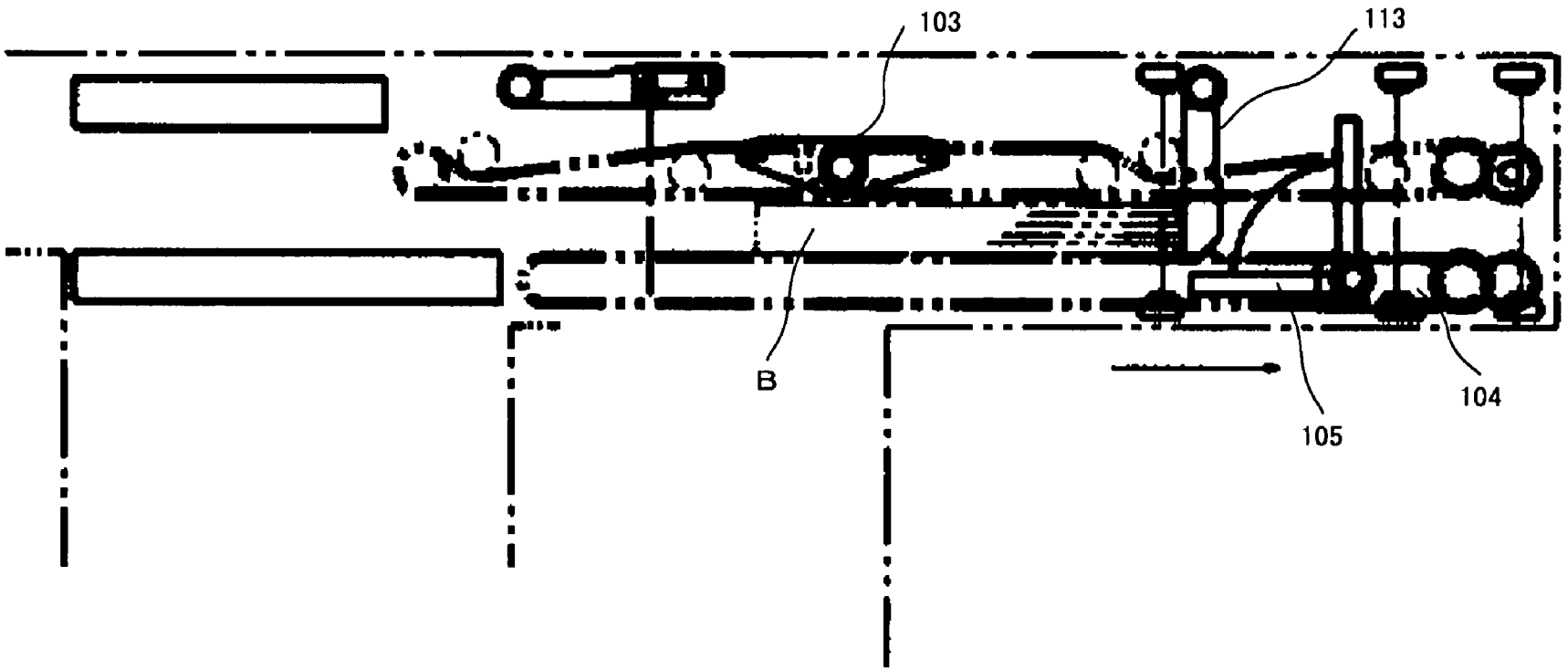
FIG. 10D is an explanatory view (4) of the operation of the pre-acceptor during the depositing operation.
Figure 10E:
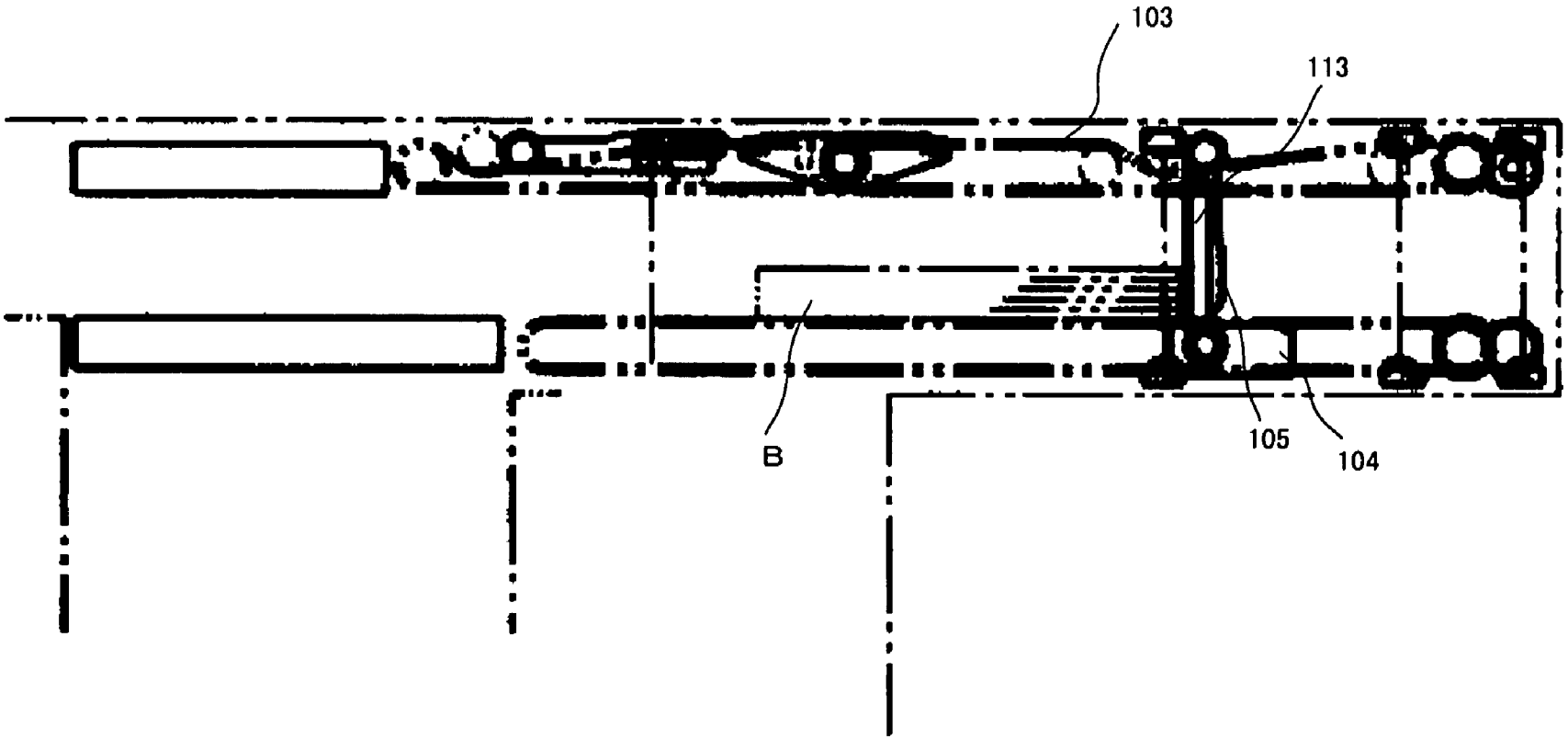
FIG. 10E is an explanatory view (5) of the operation of the pre-acceptor during the depositing operation.

First, in step 201, the A stopper 113 is projected as shown in FIG. 10C. In the next step 202, the clamp 103 is moved upward by a predetermined amount to reduce the pressure. Afterwards, the tray 104 is moved to the delivery position (S203), and then the hook 105 is projected (S204). By the projection, the acceptor 100 is changed to the state shown in FIG. 10D.

When the tray 104 is moved to the delivery position, it is possible that a bill contacting the tray 104 and a bill near the bill are projected in the moving direction. However, the front side of the bundle of bills B is supported by the projected A stopper 113. Therefore, the projection of the bill in the moving direction can be correctly avoided. Thus, although only the tray 104 is moved, the bundle of bills B can maintain the original state.

The clamp 103 is moved upward by the CPU 361 instructing the motor drive section 365 to rotate the motor 140 by a predetermined number of steps. The A stopper 113 can be projected by the CPU 361 instructing the solenoid drive section 367 to drive the solenoid for projecting. The hook 105 automatically returns to the projecting state by terminating the drive of the solenoid for evacuating.

In step 205 after step 204, the clamp 103 is evacuated to the position shown in FIG. 2, and the stopper 113 is evacuated. After the evacuating process, the tray 104 with the hook 105 projected is moved to the release position (S206). The release position is the back end position in the movable range of the tray 104. By the travel of the tray 104 to the release position, the acceptor 100 enters the state shown in FIG. 10F from the state shown in FIG. 10D by way of the state shown in FIG. 10E.

The clamp 103 is evacuated by moving it to the upper end position in which both the sensors 145 and 146 pass the light as shown in FIG. 7A. At this time, the number of steps of the pulse provided for the motor 140 by the time when they both pass the light is counted. The value obtained by adding the number of pulses provided when the pressure is reduced to the count value indicates the height from the state in which the pressure is applied to the bundle of bills B to the evacuating position. The height of the bundle of bills B when the pressure is applied can be calculated by subtracting the height of the bundle from the difference between the clamp 103 at the upper end position and the tray 104. By counting the number of steps, the height of the bundle of bills B when the pressure is applied is correctly obtained. The applied pressure prevents the influence of the transformation of the feed belt 123 by the shaft 121 opposing the tray 104 as shown in FIGS. 3A and 4.

By moving the tray 104, the power on the hook 105 works on the bundle of bills B by an inertial force. Therefore, the bundle of bills B is appropriately conveyed by the hook 105 supporting the bundle. As a result of the power working in the evacuating direction on the bills projecting opposite the moving direction, the bundle of bills B is corrected to the desired status depending on the current status, and is then conveyed.

Figure 10F:
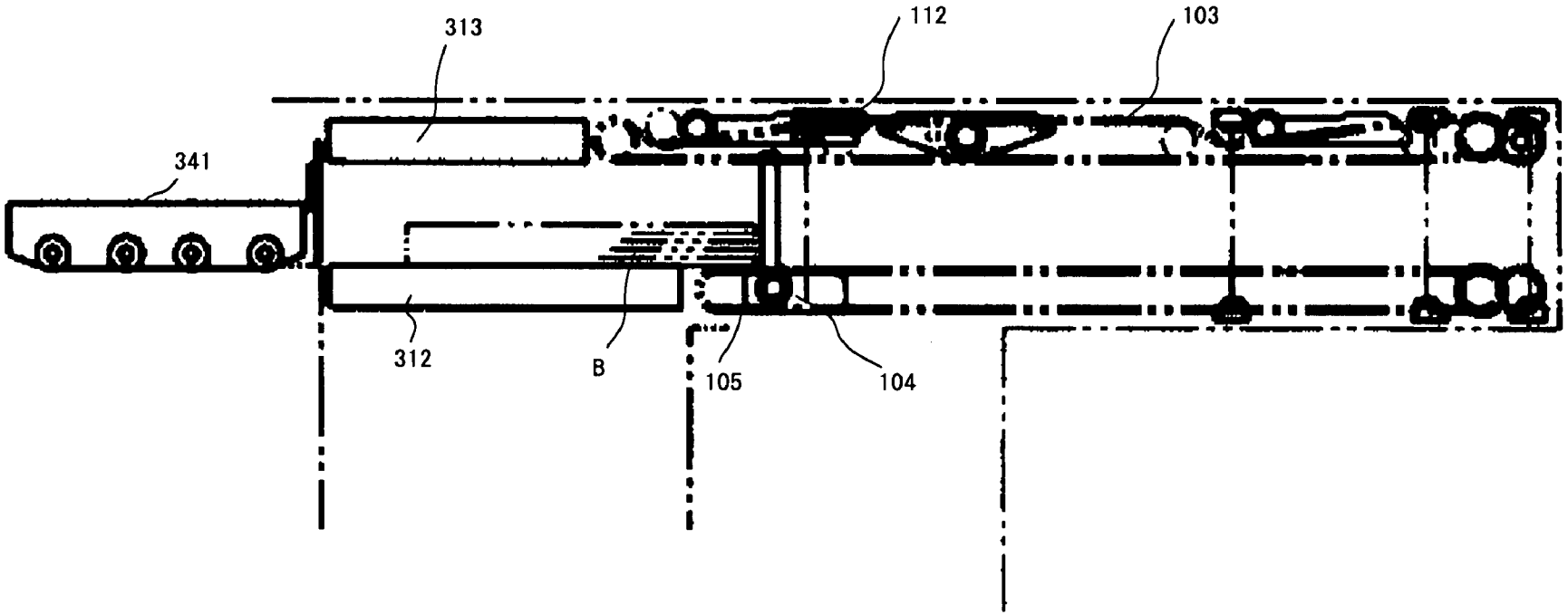
FIG. 10F is an explanatory view (6) of the operation of the pre-acceptor during the depositing operation.
Figure 10G:
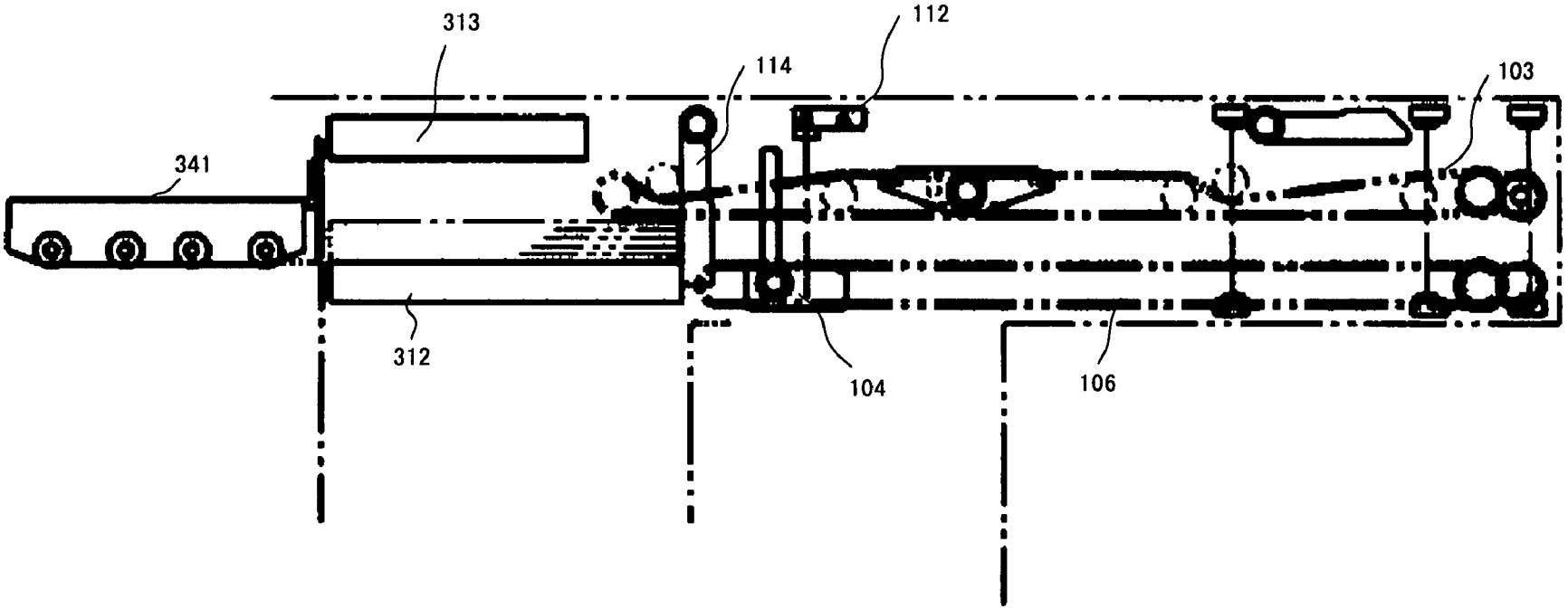
FIG. 10G is an explanatory view (7) of the operation of the pre-acceptor during the depositing operation.

When the tray 104 is stopped, the power works on the bundle of bills B in the detaching direction from the hook 105 by the inertial force. The power works in the collapsing direction on the bundle of bills B. Therefore, in the present embodiment, as shown in FIG. 10F, the carrier 341 is moved in advance to the delivery position to the separator section 310, and the disorder of the bundle of bills B is avoided by the carrier 341. The carrier 341 is moved in step 104.

In the next step 207 after step 206, the motor 140 is driven and the pressure is applied to the clamp 103. After applying the pressure, the power is transmitted to the feed belts 106 and 123, the bundle of bills B is conveyed by a predetermined distance (S208), and the stopper 114 is projected after the conveying operation (S209). Thus, after moving the acceptor 100 to the status shown in FIG. 10G, a series of processes terminate. The process in step 111 shown in FIG. 12 is performed in the status.

The conveying operation of the belt in step 208 is performed on the end of the feed belt 106. The end portion is supported by the roller provided for the shaft. Therefore, the bundle of bills B is appropriately conveyed using the belt. The D stopper 114 is projected by driving the solenoid for projecting as with the A stopper 113. By the projection of the D stopper 114, the bundle of bills B is adjusted between the D stopper 114 and the carrier 341, and is placed in the appropriate state on the stage 312 (FIG. 10G).

The processes in and after step 111 shown in FIG. 12 are explained below.

In step 111, after moving down the stage 312 to the lower end, the pusher 313 is moved down to the position (pressure position) where the appropriate pressure is applied to the bundle of bills B. In the next step 112, the carrier 341 is moved to the escrow evacuation position. To store the bills advanced from the separator section 310, each of the stages 331 and 331 of the temporarily holding section 330 is moved. Afterwards, the carrier 341 is moved to the escrow evacuation position, and each of the stages 331 and 332 of the temporarily holding section 330 is moved (S113) to store the bills advanced from the separator section 310, and the DC motor 372 is rotated (S114). The pressure is applied by the pusher 313 by monitoring the output of the sensor for detection of the stage 312 positioned when, for example, an appropriate pressure is applied to the bundle of bills B, and further lowering it by a predetermined amount after the sensor detects the stage 312.

After the DC motor 372 starts its rotation, the bills are sequentially advanced on a sheet by sheet basis from the separator section 310 and conveys the bills to the temporarily holding section 330 until the operation of advancing the bills from the separator section 310 completes (S115, S116). Thus, the bills inserted by the client are stored in the reservoir section or the escrow section.

Bills are advanced by transmitting the power to the advancing mechanism 311, and the storage of the bills is determined by the authentication section 320 authenticating the advanced bills. The bills determined as normal bills are counted for each denomination of bill. During advancing bills, the pusher 313 is intermittently moved down to apply appropriate pressure to the bills.

When the operation of advancing the bills conveyed to the separator section 310 is completed, that is, when all bills that can be advanced are completely advanced, and are stored in the temporarily holding section, the determination in step 116 is YES, control is passed to step 117, and the DC motor 372 is stopped. Then, in step 118, the pusher 313 and the stage 312 are respectively moved to the upper end position (FIG. 2), and the notification that the operation of advancing the bills has been completed and the notification of the amount of the bundle of bills B (deposit amount) inserted by the client are transmitted to the CPU 261 of the lower module 200. The deposit amount as a notification corresponds to the transaction contents.

At the notification, the ATM inquires the client whether or not a transaction (depositing transaction) is to be conducted, whether or not there is an additional deposit, etc. The lower module 200 issues an instruction depending on the inquiry result.

In step 119 after step 118, the CPU 261 determines the contents of the instruction by receiving the instruction from the ATM. When the ATM indicates an additional deposit by a request from the client, the indication is determined and control is passed to step 120. If the ATM indicates refunding the bills by a request to cancel the transaction, the indication is determined and control is passed to step 121. If the ATM indicates storing fetched bills by a request a transaction, the indication is determined and control is passed to step 122.

In step 120, the process of fetching new bills is performed by waiting for the insertion of bills by a client. The process is realized basically by performing a series of processes in steps 101 through 113. However, the fetching process shown in FIG. 13 performed in step 110 is different as follows.

To prevent forgetting taking bills by a client, it is desired to refund bills to be refunded in one operation. However, since there is still a portion to be conveyed by the bundle of bills B, there is a higher limit to the height of the bundle of bills B to be conveyed in one conveying operation. Relating to additional deposit, considering the bundle of bills B already inserted by a client, it is necessary for the height accumulated by the entire bundle of bills B not to exceed the upper limit of the height. Thus, the height of the accumulation of the entire bundle of bills B is obtained, and when the height exceeds the upper limit, the bundle of bills B newly inserted by a client is refunded.

As described above, in step 205, the clamp 103 is evacuated, and the height of the inserted bundle of bills B is obtained. When there is additional deposit, the height obtained before when a client inserts the bundle of bills B is added to the height of the additional deposit, thus the accumulated height is calculated, and it is determined whether or not the calculated height exceeds the upper limit. Thus, when the accumulated height exceeds the upper limit, the bundle of bills B newly inserted by the client is refunded, the notification is transmitted to the ATM, and control is passed to step 119 to await an instruction from the ATM. If the accumulated height does not exceed the upper limit, then control is passed to step 206, the subsequent processes are similarly performed, and control is passed to step 114. FIG. 12 shows only the latter case.

Above determination and refunding the bundle of bills B depending on the determination result are performed when there is additional deposit, the bills can be refunded in one refunding operation. Therefore, the occurrence of a client forgetting taking bills can be avoided. The acceptor 100 checks the height of the bundle of bills B so that a necessary process can be performed at an earlier stage and the reduction in use efficiency of the paper sheet handling apparatus 1 due to the insertion of a large number of bills by a client can be avoided.

In step 121 to which control is passed when the ATM indicates refunding bills by a client requesting to cancel a transaction, a refund process for refunding fetched bills is performed. In step 122 to which control is passed when the ATM indicates storing fetched bills by requesting a transaction, a storing process for storing fetched bills in the bill cassette 210 is performed. After performing any of the processes, a series of processes terminate.

Figure 14:
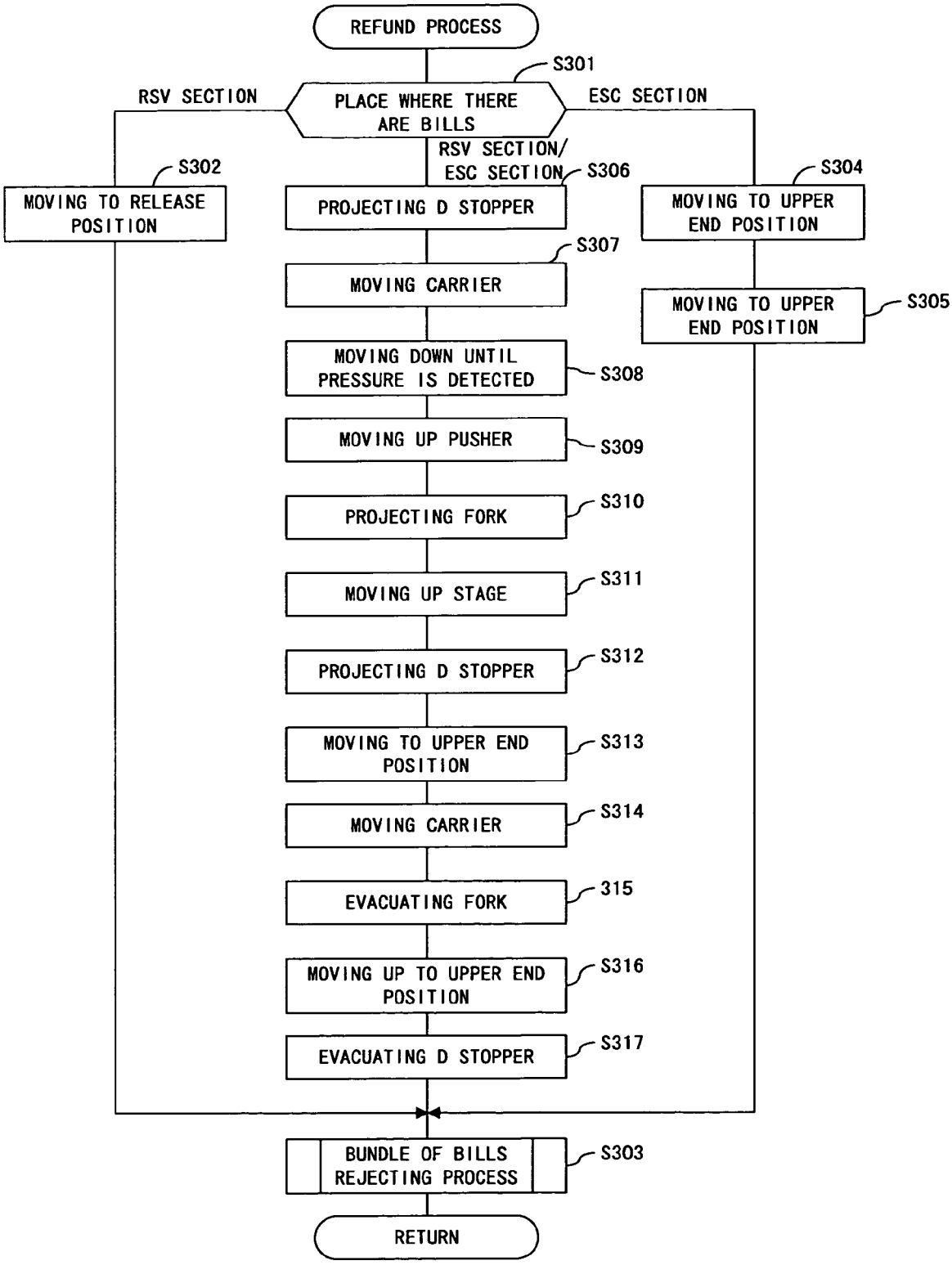
FIG. 14 is a flowchart of the refund process.

FIG. 14 is a flowchart of the refund process performed as the process in step 121. The refund process is explained in detail by referring to FIG. 14.

The bills advanced by the separator section 310 are conveyed either the reservoir section or the escrow section, and stored therein. Thus, the case in which the bills are stored only in the reservoir section, the case in which they are stored only in the escrow section, and the case in which they are stored in both of them are explained below. The explanation is given by considering the CPU 361 of the upper module 300. The CPU 361 indicates refunding the bills fetched from the CPU 261 of the lower module 200.

First, in step 301, the place where bills are located is determined. When the bills are stored only in the reservoir (RSV) section, it is determined and control is passed to step 302.

When bills are stored only in the escrow (ESC) section, it is determined and control is passed to step 304. When the bills are stored both in the reservoir (RSV) section and the escrow (ESC) section, it is determined and control is passed to step 306. The existence of bills is determined based on the detection result by the sensor provided for each section, or based on the authentication result.

In step 302, the RSV stage 331 is moved to the release position. Afterwards, control is passed to step 303, and the bills are refunded to the client by performing the bill ejecting process described later in detail. Then, a series of processes terminate.

In step 304 to which control is passed to passed when bills are stored only in the escrow (ESC) section, the RSV stage 331 is moved to the upper end position. Then, in step 305, the ESC stage 332 is moved to the upper end position. Afterwards, the bills are refunded to the client by performing the bill ejecting process in step 303.

In step 306 to which control is passed when bills are stored in both the reservoir (RSV) section and the escrow section (ESC), the RSV stage 331 is moved to the release position, and the D stopper 114 is projected. Then, in step 307 to which control is passed next, the carrier 341 positioned in the escrow evacuation position is moved to the delivery position (FIG. 10F) of the separator section 310, the bundle of bills B on the RSV stage 331 is conveyed to the stage 312, and then the carrier 341 is returned to the evacuation position. Then, control is passed to step 308. The D stopper 114 is projected to convey the bundle of bills B to the 213 in an appropriate state as shown in FIG. 10G.

In step 308, the pusher 313 is moved down to the position in which an appropriate pressured can be applied after the stage 312 is moved to the lower end as in the bill advancing operation. In the next step 309, the pusher 313 is moved up until the sensor for detecting the position do not detecting the stage 312. In the next step 310, the pusher 313 is moved up to the joint preparation position, and the fork 342 is projected. Then, control is passed to step 311.

When the pusher 313 is moved up to the joint preparation position, the amount of move-up is obtained by counting the number of steps of the pulse applied to the stepping motor for movement. In step 311, the amount of move-up for the stage 312 is determined from the obtained amount of move-up, and the stage 312 is moved up. In the next step 313, the RSV stage 331 and the ESC stage 332 are moved to the upper end position. Thus, the bundle of bills B on the ESC stage 332 is set in the movable state, and control is passed to step 314.

The bundle of bills B on the ESC stage 332 falls and joined to the bundle of bills B in the separator section 310. When the amount of the fall is excessive with the size of the bill taken into account, the bills can be piled in an inappropriate state when the bundle falls. The amount of move-up of the stage 312 is determined by performing the processes in steps 308 through 311 to suppress the amount of fall of the bundle of bills B and prevent the inappropriate state.

In step 314, the carrier 341 is moved to the delivery position to the separator section 310. Then, it is returned to the escrow evacuation position. In the next step 315, the fork 342 is evacuated, and the conveyed bundle of bills B falls on it. Afterwards, the stage 312 is moved to the upper end position in step 316, and in the next step 317, the D stopper 114 is evacuated, and control is passed to step 303.

Thus, when the bills are stored both in the reservoir section and the escrow section, the bills are collected as one bundle by using the separator section 310, and refunded to the client. Thus, the bills to be refunded are refunded in one operation, and forgetting taking the bills can be suppressed.

All bills are not necessarily advanced. When all bills are not advanced completely, the remaining bills are left in the separator section 310. The remaining bills are not shown in the attached drawings, but the bills stored in the temporarily holding section 330 are collectively refunded. The refund is realized in basically the same method as in collecting the bills stored in the reservoir section and conveyed to the separator section 310 with the bills in the escrow section.

When there are remaining bills, the bills cannot be advanced from the additionally deposited bundle of bills B. Thus, when an additional deposit is made, after the remaining bills are refunded, which is not shown in the attached drawings, the client is requested to insert the bundle of bills B. When there are bills stored in the reservoir section, the bills are collectively refunded as remaining bills. The process is similarly performed when a client requests a transaction after confirming the contents of the transaction, that is, when the bills in the escrow section are stored in the bill cassette 210.

Figure 15:
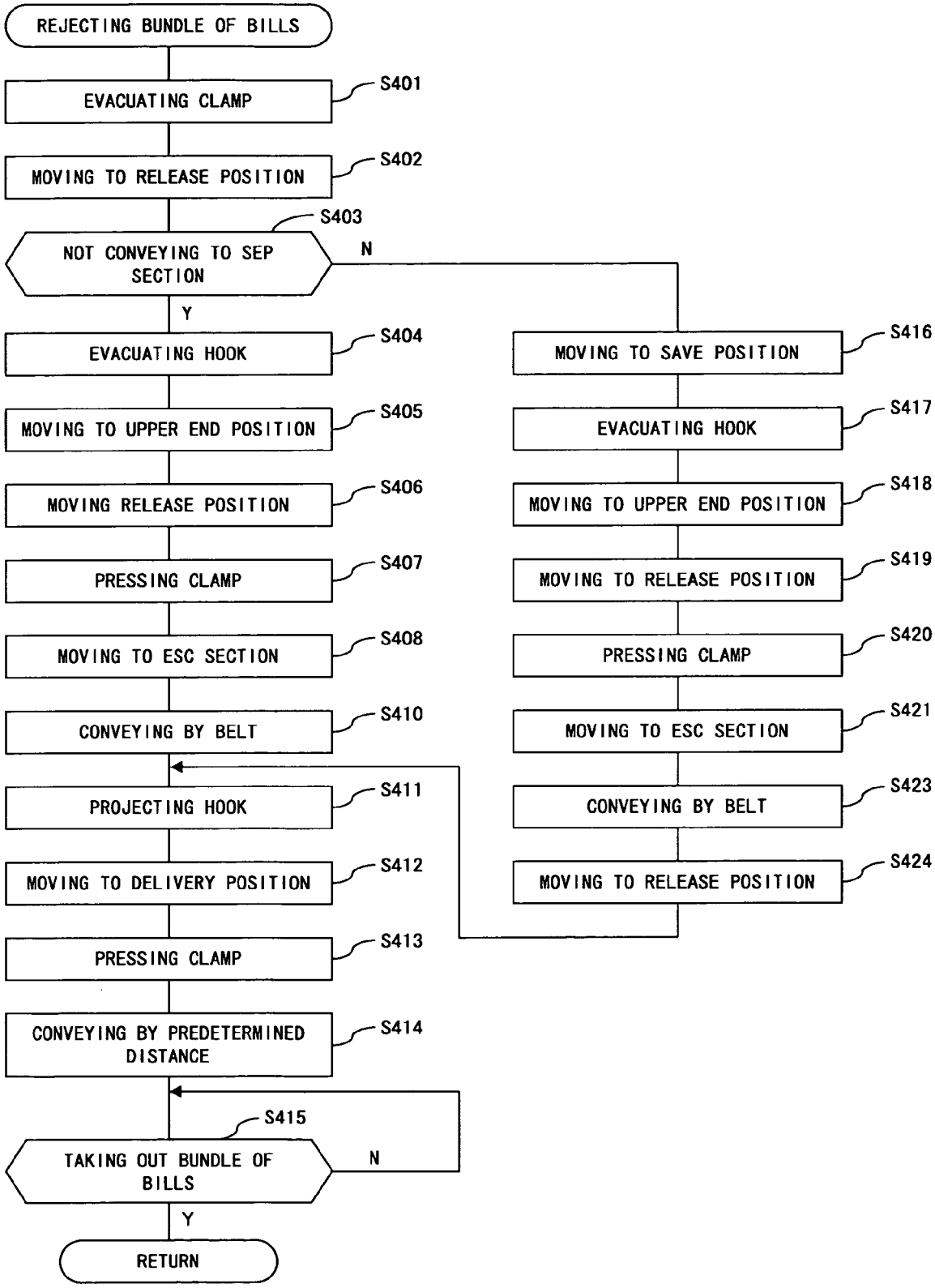
FIG. 15 is a flowchart of the bill ejecting process.

The bill ejecting process performed as the process in step 303 is explained below by referring to the flowchart shown in FIG. 15 and by referring to FIGS. 11A through 11F. Since the ejection of bills is realized by the operation of the upper module 300, the explanation is given by considering the CPU 361 of the upper module 300. The subsequent explanation is similarly given unless otherwise specified.

In step 401, the clamp 103 is evacuated. In step 402, the tray 104 is moved to the release position (FIG. 11C) of the acceptor 100. In the next step 403, it is determined whether or not bills have been conveyed to the separator section 310 immediately before. If there are bills in the reservoir section and the escrow section as described above, the bills are collected in the separator section 310, and then the bill ejecting process is performed. In this case, the determination is NO, and control is passed to step 416. Otherwise, that is, the determination is NO, and control is passed to step 404.

In step 404, the hook 105 is evacuated. Afterwards, the stage 312 is moved to the upper end position in step 405. In step 406, the carrier 341 is moved to the release position (FIG. 11A). In step 407, pressure is applied by the clamp 103. In step 408, the carrier 341 is moved to the escrow evacuation position. After starting the movement, control is passed to step 410, and the bundle of bills B is conveyed using a belt.

Figure 11D:
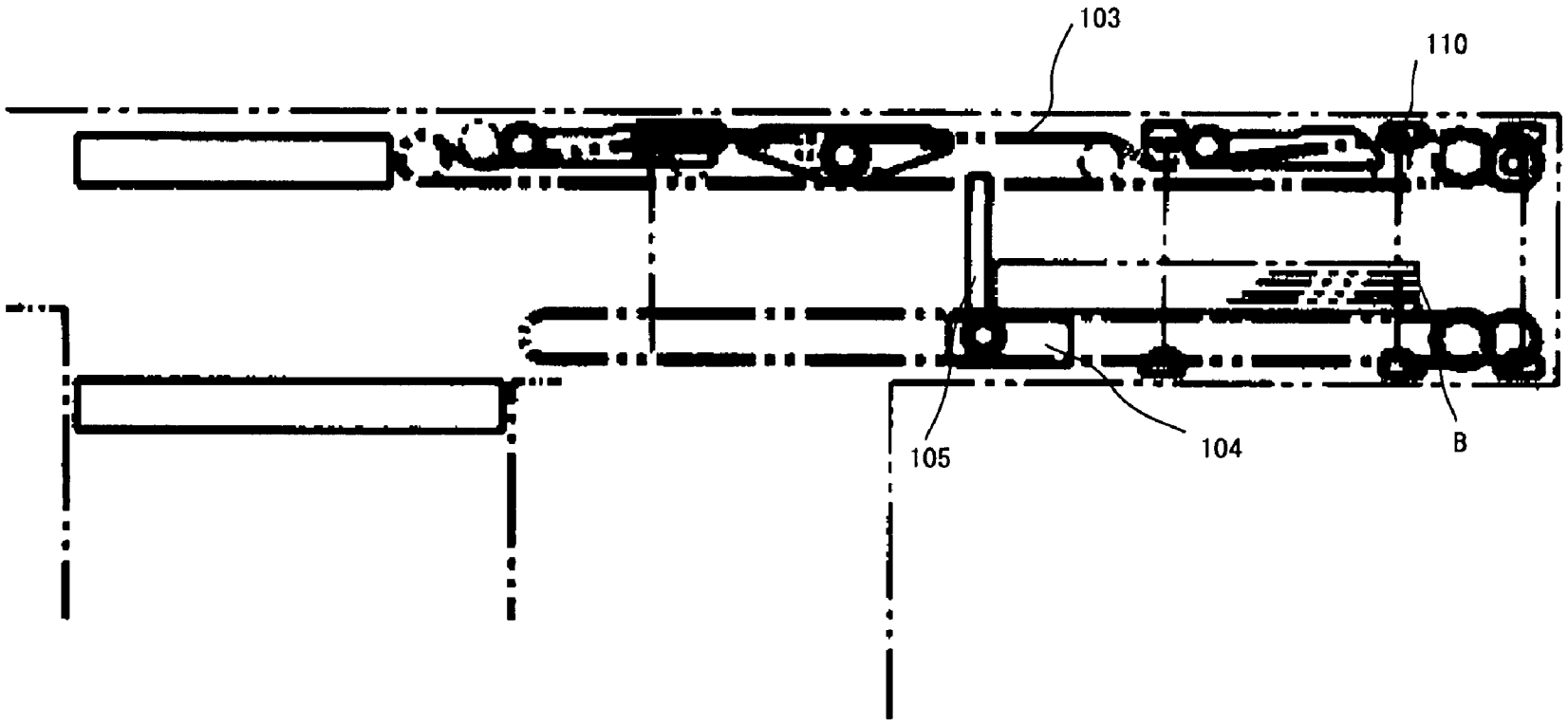
FIG. 11D is an explanatory view (4) of the operation of the pre-acceptor during the withdrawing operation.

The conveying operation by a belt is performed until the sensor 112 (FIG. 2) completes detecting the bundle of bills B. After performing the conveying operation by a belt, control is passed to step 411, the clamp 103 is evacuated, and the hook 105 is projected. In the next step 412, while transmitting the power to the feed belts 106 and 123, the travel of the tray 104 to the delivery position is started (FIG. 11D). Then, control is passed to step 413.

Figure 11E:
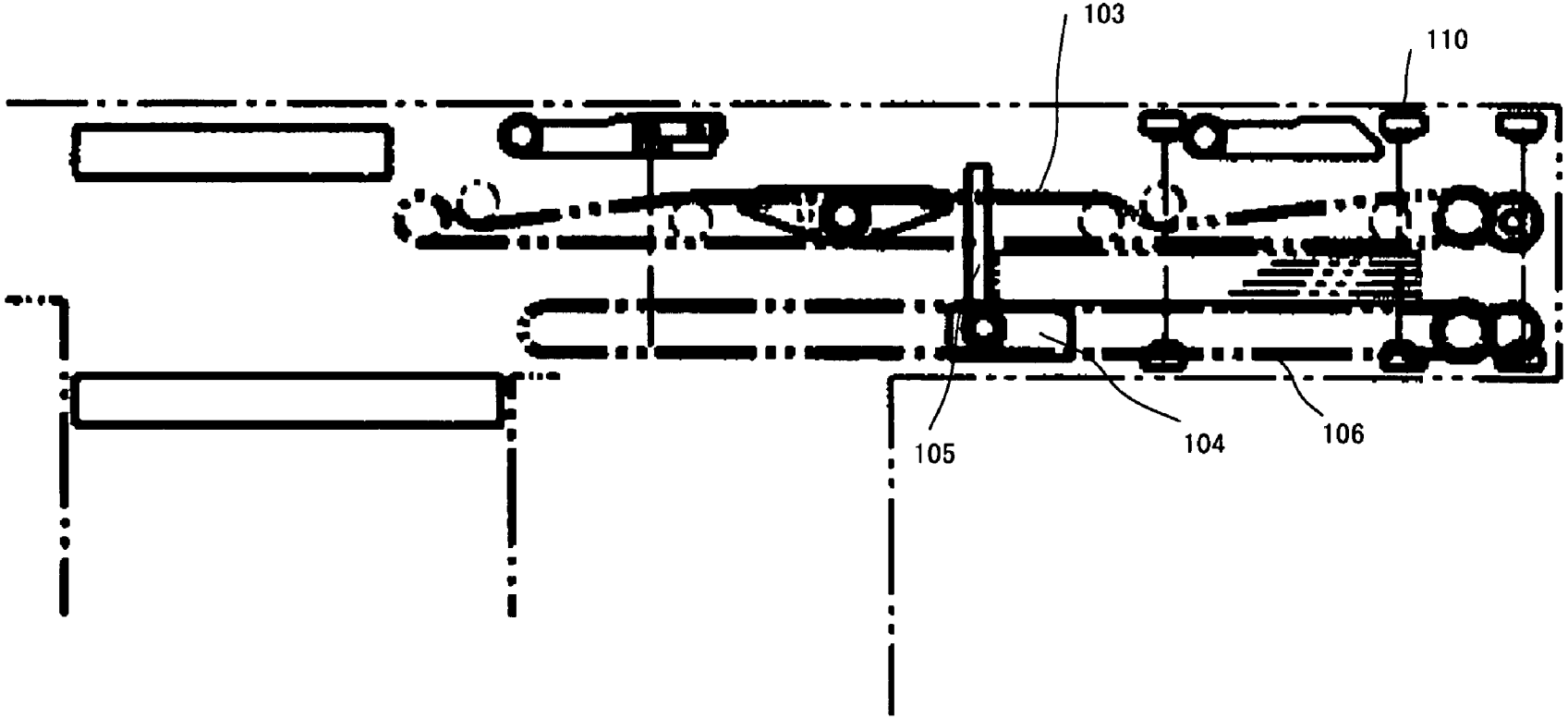
FIG. 11E is an explanatory view (5) of the operation of the pre-acceptor during the withdrawing operation.
Figure 11F:
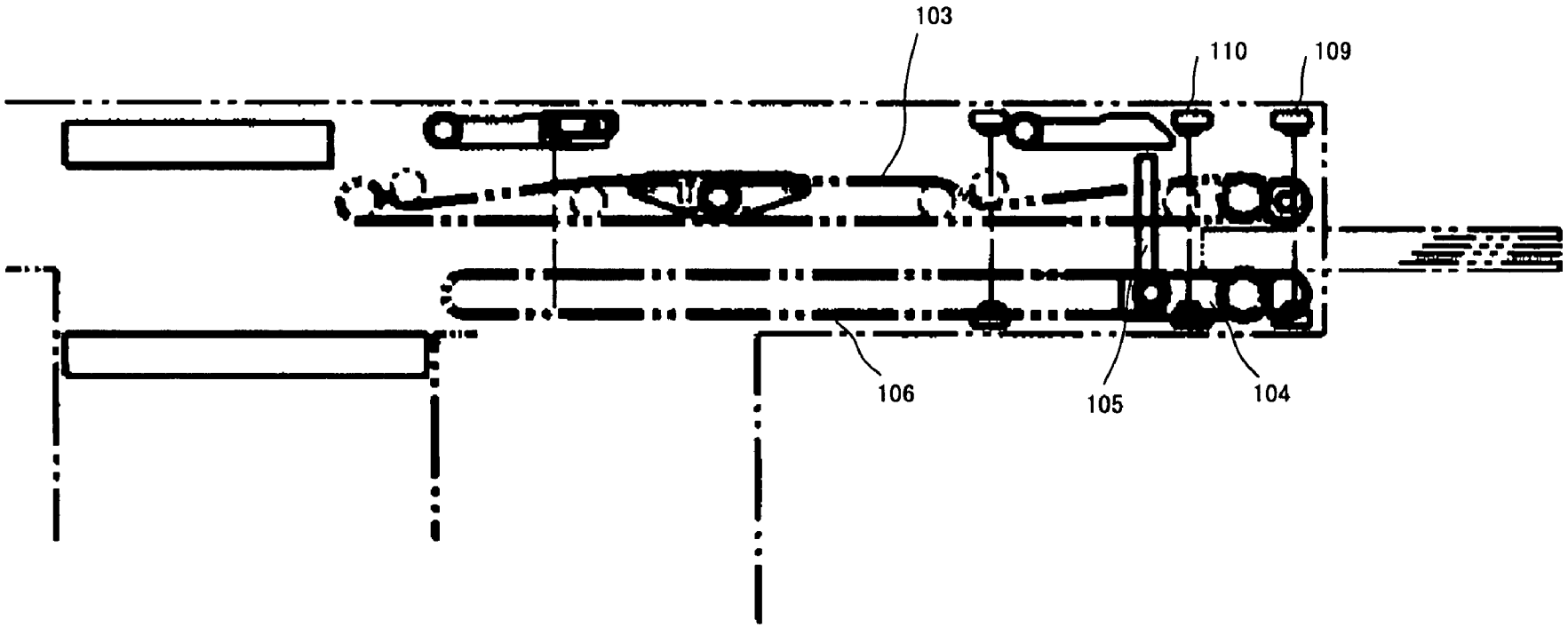
FIG. 11F is an explanatory view (6) of the operation of the pre-acceptor during the withdrawing operation.

In step 413, as shown in FIG. 11E, pressure is applied by the clamp 103 after the sensor 110 (FIG. 2) detects the bundle of bills B. In the next step 414, after the tray 104 is moved to the delivery position, the process of conveying the bundle of bills B for a predetermined distance is performed. Afterwards, control is passed to step 415, and taking out the bundle of bills B is awaited. When the sensors 109*a* through 109*d* stops detecting the bundle of bills, it is determined that the bundle of bills B have been taken out, and the information is transmitted to the CPU 261 of the lower module 200. Thus, after the CPU 261 notifies the ATM of the information, a series of processes terminate.

The travel of the tray 104 to the delivery position is performed by counting the pulse signal output by the sensor 107*b* of the encoder 107 after the sensor 111 stops detecting the tray 104 (bundle of bills B). The conveying operation to the position forward the delivery position is performed to allow a client to easily take out the bundle of bills B. Applying the pressure by the clamp 103 is performed to avoid the collapse of the bundle of bills B.

In step 416 to which control is passed after the determination in step 403 is NO, the tray 104 is moved to the save position forward the release position. Afterwards, the hook 105 is evacuated in step 417, the stage 312 is moved to the upper end position in step 418, the carrier 341 is moved to the release position in step 419, and then control is passed to step 420. The state shown in FIG. 11A is entered when control is passed to step 420. The tray 104 is moved to the save position so that the evacuated hook 105 cannot contact the bundle of bills B on the stage 312.

In step 420, the clamp 103 applies pressure. In the next step 421, the carrier 341 is moved to the escrow evacuation position. Thus, after entering the state shown in FIG. 11B, the conveying operation by a belt is performed in step 423 until the sensor 112 stops detecting the bundle of bills B. In the next step 424, the conveying operation is stopped, and the tray 104 is moved to the release position. Afterwards, control is passed to step 411. By performing the process in step 411, the acceptor 100 enters the state shown in FIG. 11C.

Figure 16:
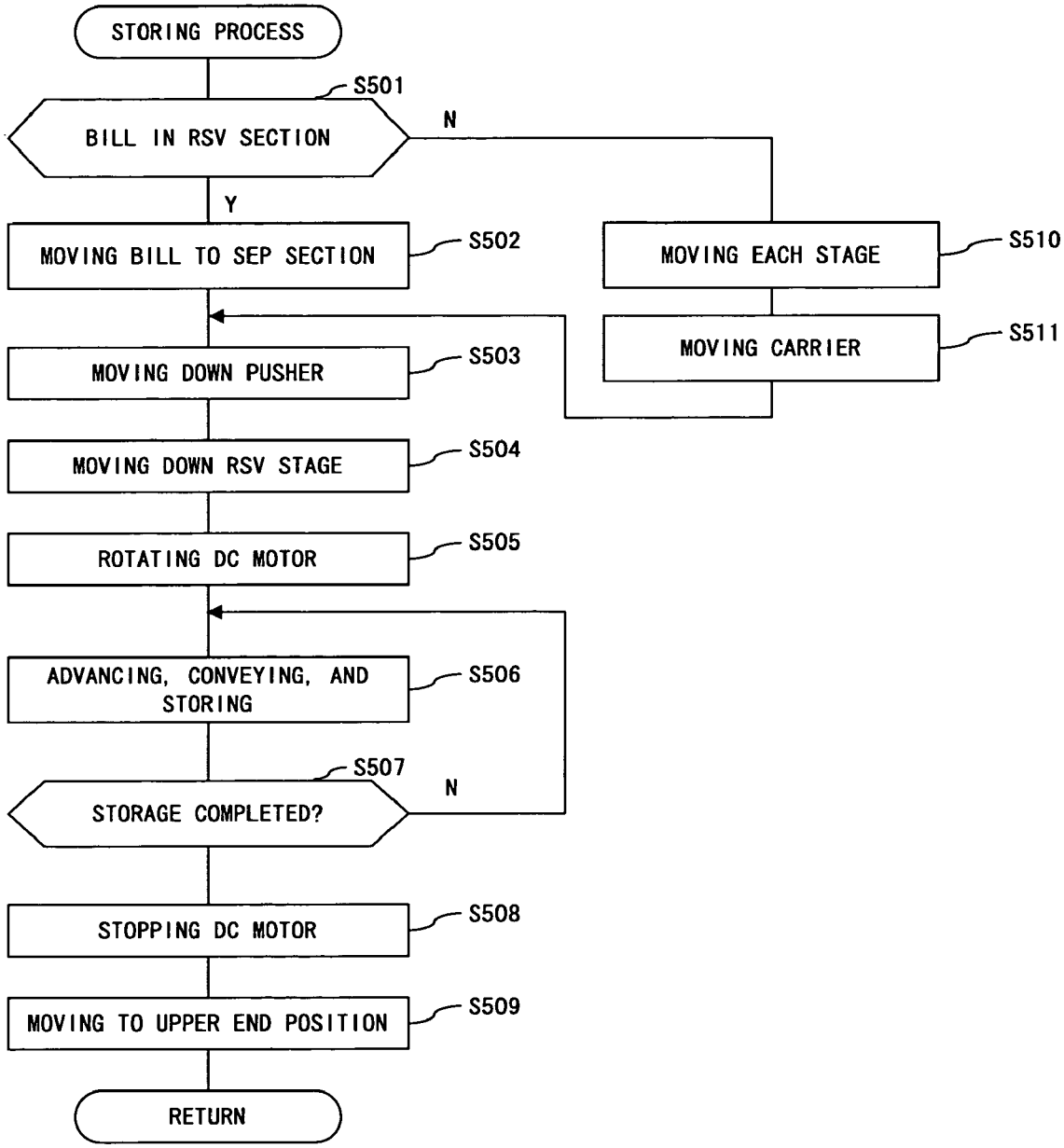
FIG. 16 is a flowchart of the storing process.

FIG. 16 is a flowchart of the storing process performed in the depositing process shown in FIG. 12 in step 122. Then, by referring to FIG. 16, the storing process is explained in detail.

First, in step 501, it is determined whether or not there are bills in the reservoir section. When the authentication section 320 determines that all bills are normal, the determination is NO, and control is passed to step 510 because there are no bills stored in the reservoir section. Otherwise, the determination is YES, and control is passed to step 502.

In step 502, the bills on the reservoir section is refunded to the client, and the bills in the escrow section is moved to the stage 312 of the separator section 310. After the movement, the carrier 341 is returned to the escrow evacuation position. In the next step 503, the stage 312 is moved down to the lower end position, and the pusher 313 is moved down to the pressure position. Afterwards, the RSV stage 331 is moved down in step 504, and then control is passed to step 505. The RSV stage 331 (and the ESC stage 332) is moved down because there can be bills that are determined as abnormal bills due to the double convey in advancing and authentication, etc. These bills are conveyed to the separator section 310 and checked for authentication. If they are determined as abnormal bills, they are conveyed to the reject box 351 or 352 for storage.

In step 505, the DC motor 372 is rotated. By notifying that advancing bills is started, the CPU 261 of the lower module 200 rotates the DC motor forming part of the motor group 272 using the motor drive section 267. Thus, the conveying path 201 is set in the state in which the bills being conveyed on the conveying path 201 can be stored in the bill cassette 210. Afterwards, bills are sequentially advanced from the separator section 310, conveyed to the bill cassette 210 to store the bills until the operation of advancing the bills from the separator section 310 is completed (S506, S507). Thus, the bills inserted by the client are stored in the bill cassette 210 for each denomination of bill.

The advanced bills are checked for authentication by the authentication section 320. The CPU 361 notifies the CPU 261 of the denomination of bill determined in the authentication. According to the notification, the CPU 261 designates the bill cassette 210 for storing bills, that is, the switch hook whose status is to be changed on the conveying path 201, and instructs the solenoid drive section 265 to drive the solenoid for changing the status or stop the driving of the solenoid. Thus, the bills conveyed from the upper module 300 to the lower module 200 are stored in the bill cassette 210.

When the storage of the bills is completed, the determination in step 507 is YES, control is passed to step 508, and all rotating DC motors are stopped. In step 509, the pusher 313 and the stage 312 are moved to the respective upper end positions (FIG. 2). Then a series of processes terminate.

For example, when the CPU 361 completes advancing the bills, the information is transmitted to the CPU 261. Upon receipt of the information, the CPU 261 determines the completion of the storage of the bills on condition that bills are not detected on the conveying path 201 for a predetermined time. The CPU 361 waits for a notification of the completion of the storage from the CPU 261, and stops the DC motor 372. The CPU 261 transmits the notification also to the ATM.

Figure 17:
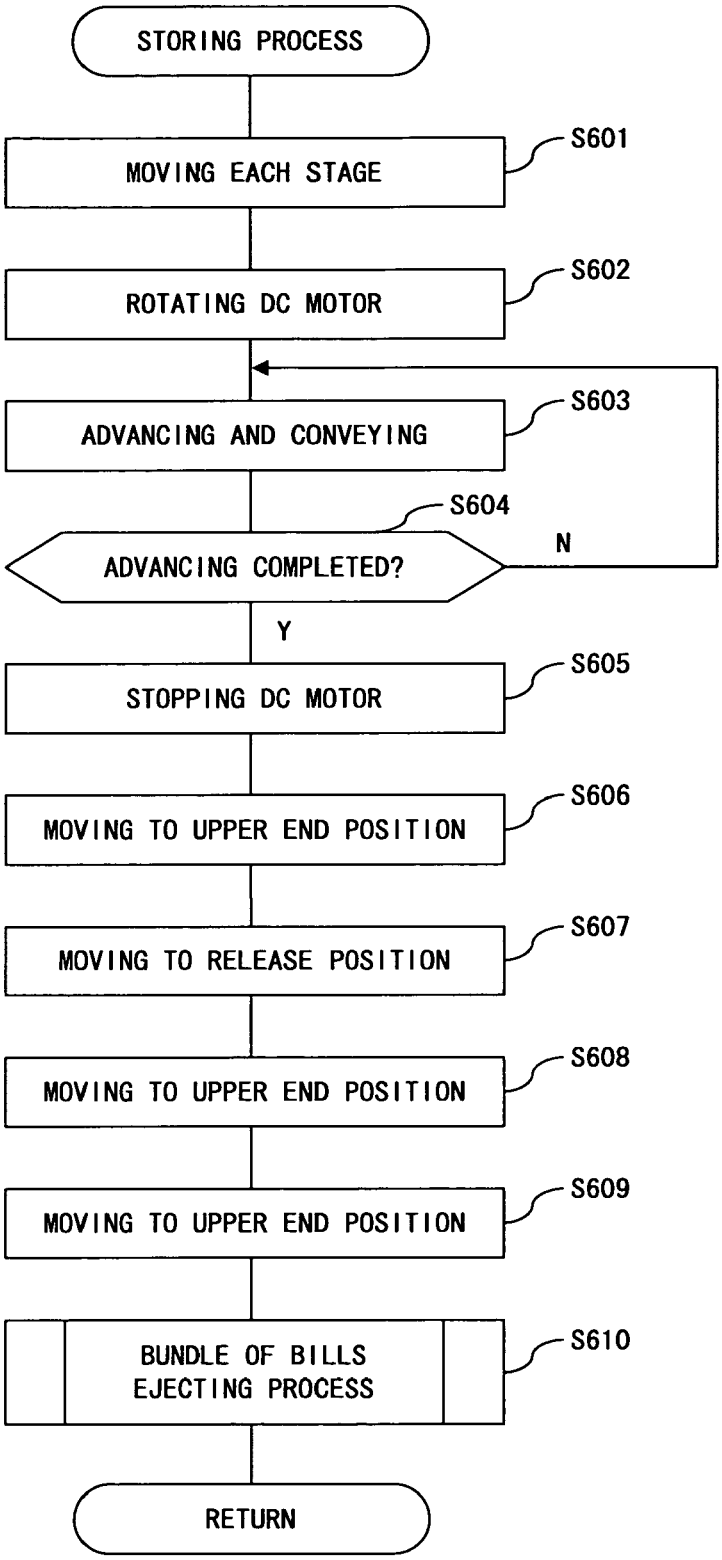
FIG. 17 is a flowchart of the withdrawing process.

FIG. 17 is a flowchart of the withdrawing process. The process is performed at an instruction from the ATM to realize the withdrawal transaction requested by a client. Finally, by referring to FIG. 17, the withdrawing process is explained below in detail.

First, in step 601, each of the stages 331 and 332 of the temporarily holding section 330 is moved and the state in which bills can be stored is entered. In step 602, the DC motor for conveying bills is rotated in the upper module 300 and the lower module 200. Afterwards, until bills are completely advanced from the bill cassette 210, the bills are sequentially advanced on a sheet by sheet basis from the bill cassette 210 and conveyed (S603, S604).

The bills advanced from the bill cassette 210 are conveyed to the temporarily holding section 330 through the conveying path 201, the conveying path 306 of the upper module 300, the authentication section 320, the conveying path 302, and the conveying path 303. Since normal bills are stored in the bill cassette 210, the bills advanced from the bill cassette 210 are stored in the escrow section.

The ATM notifies the CPU 261 of the lower module 200 of the contents of the transaction. The CPU 261 determines the bill cassette 210 from which bills are to be advanced, and the number of bills to be advanced from the bill cassette 210 based on the notified contents of the transaction, and advances the bills from the bill cassette 210 using the advancing mechanism 211 based on the determination. When the advancing operation is completed, the determination in step 604 is YES, control is passed to step 605, and the rotating DC motors are all stopped.

The DC motor 372 of the lower module 200 is stopped when, for example, the advancing operation is completed, a predetermined time has passed, and then the CPU 261 indicates the stop to the CPU 361. The processes in steps 601 and 602 are also realized by an instruction of the CPU 261. These processes are the same as those in the steps performed in and after step 605.

In step 606 after step 605, the RSV stage 331 is moved to the upper end position. In the next step 607, the ESC stage 332 is moved to the release position. Afterwards, the pusher 313 is moved to the upper end position in step 608. In step 609, the stage 312 is moved to the upper end position, then control is passed to step 610, and the bill ejecting process shown in FIG. 15 is performed. A series of processes then terminate.

In the present embodiment, both tray 104 and hook 105 are used in conveying the bundle of bills B, but only one of them can be used. Using only one of them, the bundle of bills B can be conveyed more appropriately than in the related art.

Figure 18:
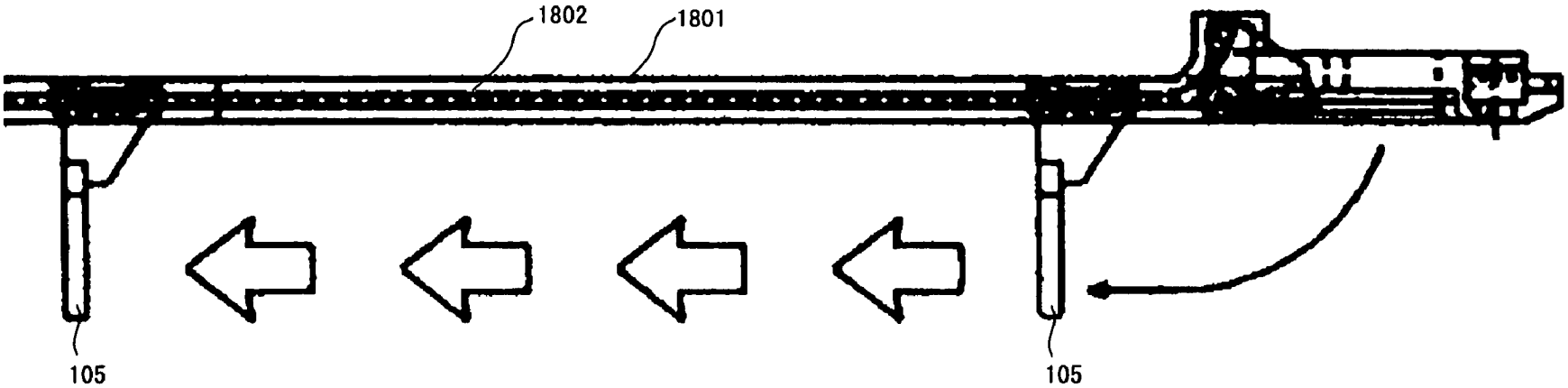
FIG. 18 is an explanatory view of a variation example of a hook.

The hook 105 is attached to the tray 104, but the attachment method is not limited to this application. For example, as shown in FIG. 18, the hook 105 can be attached to the 1801, and can be moved by a belt 1802 along the guide 1801. A plurality of hooks can be provided to vary the movable range.

Figure 19:
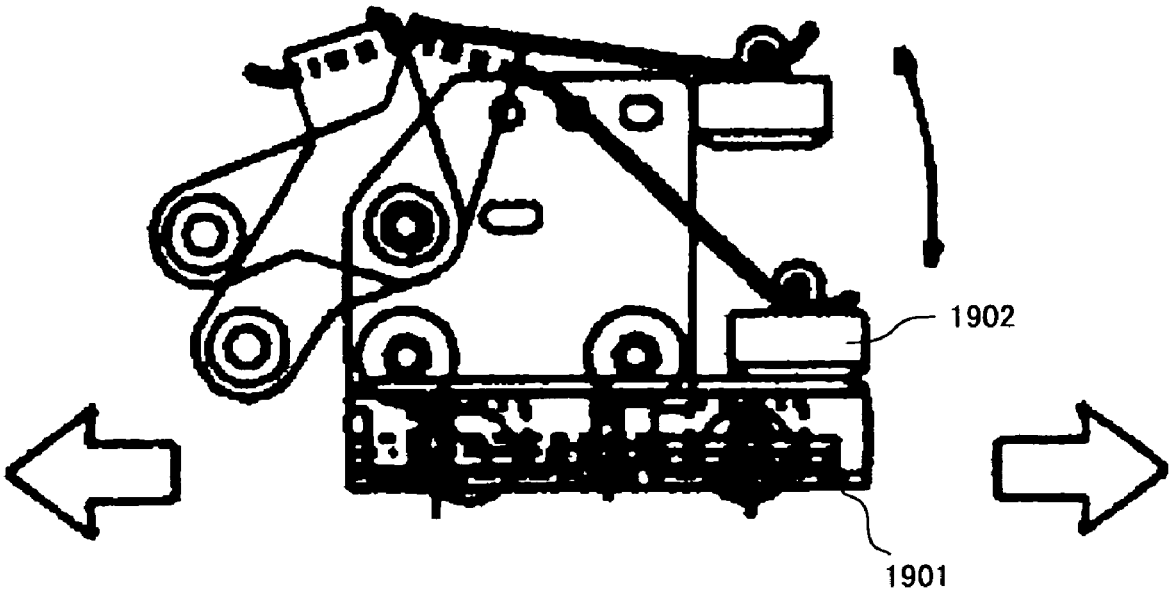
FIG. 19 is an explanatory view of a variation example of a tray.

A tray can be designed such that a tray 1901 is provided with a clamp 1902 as shown in FIG. 19, and the tray 1901 can hold the bundle of bills B on the tray 1901. Thus, variations can be devised.

When the variations shown in FIGS. 18 and 19 are adopted, the bundle of bills B inserted by a client can be conveyed by holding them on the tray 1901 using the clamp 1902. After the conveying operation, they can be further conveyed using the hook 105. With the configuration, during the withdrawing operation, for example, after the bundle of bills B are conveyed in the ejection direction using the hook 105, the bundle of bills B can be held by the clamp 1902, conveyed, and then ejected.

What is claimed is:

1. A paper sheet handling apparatus capable of handling an externally inserted paper sheet, comprising:

a first bundle conveying section conveying a bundle of paper sheets formed by piling one or more paper sheets by externally inserting the bundle;

an advancing section advancing the paper sheets on a sheet by sheet basis from the bundle of paper sheets conveyed from the first bundle conveying section;

temporarily holding section for temporarily piling and temporarily storing the paper sheets;

a storage section sorting and storing the paper sheets;

a first conveying section conveying the paper sheet advanced by the advancing section to the temporarily holding section;

a second bundle conveying section conveying a bundle of paper sheets stored in the temporarily holding section to the advancing section; and a second conveying section conveying to the storage section the paper sheet advanced by the advancing section after the second bundle conveying section conveys the bundle of paper sheets.

2. The apparatus according to claim 1, further comprising:

An other advance section for advancing on a sheet by sheet basis the paper sheet from the storage section; and a third conveying section conveying the paper sheet advanced by the other advance section to the temporarily holding section, wherein the bundle of a paper sheet stored in the temporarily holding section by the third conveying section can be externally conveyed by the second bundle conveying section and the first bundle conveying section.

3. The apparatus according to claim 1, further comprising:

diagonal status detection section for detecting the diagonal status of the bundle of paper sheets conveyed by the first bundle conveying section by external insertion, wherein when the diagonal status detection section detects the diagonal status of the bundle of paper sheets, the bundle of paper sheets is externally conveyed by the first bundle conveying section.

4. The apparatus according to claim 1, further comprising:

height detection section for detecting a height of the bundle of paper sheets conveyed by the first bundle conveying section by external insertion, wherein when the height of the bundle of paper sheets detected by the height detection section is higher than an upper limit value, the bundle of paper sheets is externally conveyed by the first bundle conveying section.

5. The apparatus according to claim 4, wherein when the paper sheets are externally inserted in plural inserting operations, the upper limit value is updated based on the height detected by the height detection section for each inserted bundle of paper sheets.

6. The apparatus according to claim 1, wherein:

the temporarily holding section stores separately paper sheets to be externally ejected and paper sheets can be stored in the storage section in the bundle of paper sheets inserted from the externally;

the advancing section can form a space storing the bundle of paper sheets; and the external ejection of the bundle of paper sheets separately stored in the temporarily holding section is collectively performed using a space formed by the advancing section.

7. An automatic transaction apparatus which conducts a transaction based on an externally inserted paper sheets, comprising:

a first bundle conveying section conveying a bundle of paper sheets by externally inserting the bundle;

an advancing section advancing paper sheets on a sheet by sheet basis from the bundle of paper sheets conveyed from the first bundle conveying section;

an authentication section authenticating the paper sheet advanced by the advancing section;

temporarily holding section for piling sorted paper sheets and temporarily storing the paper sheets depending on an authentication result of the authentication section;

a storage section piling and storing the paper sheets;

a first conveying section conveying the paper sheets advanced by the advancing section to the temporarily holding section;

a second bundle conveying section conveying a bundle of paper sheets stored in the temporarily holding section to the advancing section; and a second conveying section conveying to the storage section the paper sheets advanced by the advancing section after the second bundle conveying section conveys a bundle of paper sheets, wherein a transaction is conducted based on an authentication result of the externally input paper sheets.

8. A paper sheet conveying apparatus loaded for convey of paper sheets piled on a paper sheet handling apparatus, comprising:

a tray provided at one end of a cross direction to a plane of the paper sheet inserted in a form of the bundle of paper sheets;

travel section for moving the tray in a convey direction of the bundle of paper sheets; and pressure section for allowing pressure to the tray to work on the bundle of paper sheets.

9. The apparatus according to claim 8, wherein the pressure section allows the pressure to work on the bundle of paper sheets by moving convey section provided at the other end of the cross direction for convey of the bundle of paper sheets toward the tray.

10. The apparatus according to claim 9, further comprising:

a projecting member capable of making a projection toward one of the conveying section and the tray, evacuating from a status of the projection, and moving the bundle of paper sheets in a convey direction, wherein the bundle of paper sheets is conveyed using the projecting member.

11. The apparatus according to claim 10, wherein the bundle of paper sheets is conveyed using the projecting member by entering a state in which the bundle of paper sheets pinched by the conveying section and the tray through the pressure section, conveying the bundle of paper sheets by the conveying section and the tray, and then releasing the pinching state by the pressure section, and moving the projecting member in the projected status from the back in the conveying direction of the bundle of paper sheets to the conveying direction.

12. The apparatus according to claim 10, wherein the projecting member is used with a guide of a length with which the bundle of paper sheets is to be inserted with the projecting member in the projecting state.

13. The apparatus according to claim 10, wherein the projecting member is attached to the tray.

14. The apparatus according to claim 13, wherein when the bundle of paper sheets is externally inserted, the projecting member attached at the tray is first used for the guide of a length with which the bundle of paper sheets is to be inserted with the projecting member set in the projected state, and then evacuated, next the tray is moved in an inverse direction of the conveying direction, and the projecting member is projected, thus uses conveying the bundle of paper sheets.

15. The apparatus according to claim 14, further comprising:

an other projecting member provided opposite side of the tray in which can be made projecting toward the tray and evacuating from projected state, wherein when the tray is moved in the inverse direction of the conveying direction, the state of the bundle of paper sheets is maintained by the other projecting member in the projected state.

16. A paper sheet conveying apparatus loaded to convey a piled bundle of paper sheets in a paper sheet handling apparatus, comprising:

first and second convey section provided for convey of the bundle of paper sheets on either side in the cross direction of plane of paper sheets externally inserted in a form of the bundle of paper sheets;

drive section for driving first and second convey section;

pressure section for allowing pressure to work on the bundle of paper sheets between the first and second convey section by moving at least one of the first and second convey section in the cross direction;

a projecting member capable of making a projection directed for one of the first and the second convey section, and evacuating from the projected state; and travel section for moving the projecting member in a convey direction of the bundle of paper sheets.

* * * * *